US009764888B2

(12) United States Patent
Tiesberger

(10) Patent No.: US 9,764,888 B2
(45) Date of Patent: Sep. 19, 2017

(54) CONTAINER COMPRISING A DISPENSER FOR GOODS TO BE PACKAGED

(71) Applicant: Sanner GmbH, Bensheim (DE)

(72) Inventor: Kai Tiesberger, Niedernhausen (DE)

( * ) Notice: Subject to any disclaimer, the term of this patent is extended or adjusted under 35 U.S.C. 154(b) by 98 days.

(21) Appl. No.: 14/899,150

(22) PCT Filed: Jun. 16, 2014

(86) PCT No.: PCT/EP2014/062567
§ 371 (c)(1),
(2) Date: Dec. 17, 2015

(87) PCT Pub. No.: WO2014/202530
PCT Pub. Date: Dec. 24, 2014

(65) Prior Publication Data

US 2016/0137391 A1 May 19, 2016

(30) Foreign Application Priority Data

Jun. 17, 2013 (DE) ..... 10 2013 106 288

(51) Int. Cl.
*B65D 85/62* (2006.01)
*B65D 83/04* (2006.01)

(52) U.S. Cl.
CPC ..... *B65D 83/0409* (2013.01); *B65D 85/62* (2013.01)

(58) Field of Classification Search
CPC ..... B65D 83/0409; B65D 83/0418
USPC ..... 221/163, 198, 155
See application file for complete search history.

(56) References Cited

U.S. PATENT DOCUMENTS 3,407,962 A * 10/1968 Ragan ..... B65D 83/0409 221/303
3,511,409 A * 5/1970 Huck ..... A61J 7/04 221/231
4,171,753 A 10/1979 Vreede
(Continued)

FOREIGN PATENT DOCUMENTS

AT 385486 B 4/1988
CH 385413 A 12/1964
(Continued)

OTHER PUBLICATIONS

English Language abstract for DE1777762U extracted from Espacenet.com database on Dec. 10, 2015, 4 pages.
(Continued)

*Primary Examiner* — Timothy Waggoner
*Assistant Examiner* — Ayodeji Ojofeitimi

(57) ABSTRACT

The invention relates to a container for a plurality of goods to be packaged (28), comprising a container body (2) which forms a receiving space (13) for the goods to be packaged (28), a dispenser (30) for dispensing goods to be packaged (28), and comprising a holding device (12) for fixing the goods to be packaged (28) in the receiving space (13). The container is characterized in that the holding device (12) can assume an open position, in which at least one of the goods to be packaged (28) can be moved from the receiving space (13) into the dispenser (30), and a closed position, in which the goods to be packaged (28) are fixed in the receiving space (13), and in that an actuating device (18) is provided, in order to move the holding device (12) to the open position.

20 Claims, 24 Drawing Sheets

(56) References Cited

U.S. PATENT DOCUMENTS

| | | | | |
|---|---|---|---|---|
| 4,653,668 | A * | 3/1987 | Gibilisco | B65D 83/0409 206/540 |
| 5,785,206 | A | 7/1998 | Chan | |
| 6,564,967 | B1 | 5/2003 | Stringfield et al. | |
| 2004/0074915 | A1* | 4/2004 | Hallin | B65D 83/0418 221/223 |
| 2006/0049079 | A1 | 3/2006 | Brenner | |
| 2010/0294791 | A1 | 11/2010 | Weibel et al. | |
| 2015/0151899 | A1* | 6/2015 | Reinhold | B65D 83/0409 221/1 |

FOREIGN PATENT DOCUMENTS

| | | | |
|---|---|---|---|
| DE | 1777762 | U | 11/1958 |
| DE | 102011009073 | A1 | 7/2012 |
| EP | 1494938 | B1 | 8/2006 |
| EP | 2067718 | A1 | 6/2009 |

OTHER PUBLICATIONS

English Language abstract for AT385486B extracted from Espacenet.com database on Dec. 10, 2015, 4 pages.
English Language abstract for CH385413A extracted from Espacenet.com database on Dec. 10, 2015, 4 pages.
English Language abstract for DE102011009073A1 extracted from Espacenet.com database on Dec. 10, 2015, 12 pages.
International Search Report for International Application No. PCT/EP2014/062567 dated Oct. 10, 2014.
German Search Report for German Application No. 10 2013 106 288.1 dated Dec. 3, 2013.

* cited by examiner

CONTAINER COMPRISING A DISPENSER FOR GOODS TO BE PACKAGED

RELATED APPLICATIONS

This application is the National Stage of International Patent Application No. PCT/EP2014/062567, filed Jun. 16, 2014, which claims priority to and all the advantages of German Patent Application No. DE 10 2013 106 288.1, filed on Jun. 17, 2013, the entire contents of which are hereby incorporated by reference.

TECHNICAL FIELD

The present invention relates to a container for a plurality of goods to be packaged, such as pressed bodies. The container comprises a container body which forms a receiving space for the goods to be packaged. The container also comprises a dispenser for dispensing goods to be packaged and comprises a holding device for fixing the goods to be packaged in the receiving space.

BACKGROUND OF THE DISCLOSURE

The goods to be packaged which are received in a container can be provided e.g. as pressed bodies. Examples of goods to be packaged are tablets which are used e.g. in medicine. A further example is tablets and tabs which are used in various technical fields. In many applications, such pressed bodies which are generally produced from powder can only be compacted to a limited extent. This can be the case when the pressed body is intended to dissolve rapidly during use. It is also possible that the constituents of the powder do not permit compaction with strong adhesion of the powder constituents. Such goods to be packaged can therefore be porous and easily breakable. In this manner, shaking movements during transportation can cause damage thereto.

SUMMARY OF THE DISCLOSURE

Containers for goods to be packaged comprising a dispenser are known. EP 2 067 718 A1 describes a tablet dispenser comprising a receiving space for tablets and a dispenser which allows tablets to be dispensed separately. Further containers for tablets are known from U.S. Pat. No. 6,564,967, U.S. Pat. No. 4,171,753 and EP 1 494 938 B1.

The previously known containers also comprise holding devices so that the goods to be packaged cannot move in an uncontrolled manner in the container. For this purpose, in EP 2 067 718 A1 the container accommodates a spring which pretensions the stack of tablets, which are arranged above it, in an axial container direction upwards. Comparable springs are also described in U.S. Pat. No. 6,564,967 and U.S. Pat. No. 4,171,753. However, this design has the disadvantage that sensitive goods to be packaged are not adequately protected from becoming damaged.

One non-limiting exemplary advantage of the invention is to safely packs the goods within a container and counteract damage to those goods during transportation.

One non-limiting embodiment of a container can comprise a holding device that adopts an open position, in which at least one of the goods to be packaged can be moved from a receiving space into a dispenser, and a closed position, in which the goods to be packaged are held in the receiving space. The container can further comprise an actuating device configured to move the holding device to the open position.

The design in accordance with one embodiment the invention comprising the holding device renders it possible to counteract damage to the packaged goods. By virtue of the fact that the goods to be packaged, such as e.g. tablets or tabs, are fixed by the holding device in the closed position thereof, the goods to be packaged cannot be damaged by an uncontrolled movement in the container during transportation. The holding device thus acts as a transport lock. The goods to be packaged can still be dispensed by the dispenser in a user-friendly manner. For this purpose, the holding device can be moved by the actuating device to the open position so that a designated number of goods to be packaged can pass from the receiving space into the dispenser. The goods to be packaged can then be removed or dispensed from the dispenser. The dispenser preferably permits individual goods to be packaged to be dispensed. However, it is also possible to configure the container such that in each case a plurality of goods to be packaged are provided for removal by the dispenser. Furthermore, provision can be made that the holding device is then moved to the closed position after a good to be packaged has passed into the dispenser. The goods to be packaged remaining in the receiving space are then again fixed and protected against becoming damaged. A further advantage of the design in accordance with the invention is that the production costs can be kept low. This can be decisive as the manufacturers of products regularly strive to use packaging for which costs are low.

In accordance with one advantageous embodiment of the invention, provision is made that the holding device is configured to hold a stack of goods to be packaged. Such a stack of goods to be packaged can be provided in particular as a stack of tablets. By virtue of the fact that the holding device holds a stack of goods to be packaged, the goods to be packaged can be received in the container with the space therein being utilised effectively. Moreover, the arrangement in a stack which is held by the holding device can contribute to effectively counteracting damage to the goods to be packaged.

Further improved protection against damage to the goods to be packaged can then be achieved if the holding device holds the goods to be packaged at a spaced interval with respect to the container body. This allows inter alia the goods to be packaged which are fixed by the holding device to be stored in a resiliently movable manner in the container. In this manner, any shaking of the container is transmitted in a cushioned manner to the goods to be packaged.

In accordance with a particularly advantageous embodiment of the invention, provision is made that the holding device comprises clamping device for holding the goods to be packaged in a clamping manner. The clamping attachment can contribute to the avoidance of damage to the goods to be packaged. Moreover, the clamping attachment permits ease of operation. Preferably, the entire stack of goods to be packaged can be held in a clamped manner in the receiving space.

In one development of this inventive concept, provision is made that the clamping device in the closed position apply a clamping force in a radial direction inwards to a peripheral surface of the goods to be packaged. This ensures that the goods to be packaged are fixed in a safe and secure manner. By means of the clamping force which acts from the outside upon the peripheral surface of the goods to be packaged, it is possible to achieve a non-positive connection between the clamping device and the goods to be packaged. In this case, the goods to be packaged can be e.g. cylindrical, which permits a wide distribution of the applied clamping force. Preferably, an entire stack of goods to be packaged can be held in a clamped manner by the clamping device. The holding device can be moved e.g. to the open position by moving the clamping device in a radial direction outwards. In this manner, the inner width of the clamping device can be enlarged, wherein the goods to be packaged are released so that at least one good to be packaged can be moved from the receiving space into the dispenser.

In the case of a particularly advantageous embodiment of the invention, provision is made that the clamping device comprises a holding strip and/or holding tongues which are fastened in an elastically movable manner to a holder, in order to lie against the goods to be packaged and to hold same thereby. Both the holding strip and holding tongues render it possible to hold a stack of goods to be packaged securely. Holding tongues permit particularly effective adaptation to the outer contour of the stack. Moreover, individual holding tongues can be used for fixing the goods to be packaged in each case individually. In this case, provision can be made that the holding strip or the holding tongues lie with elastic pretensioning against the goods to be packaged. The elastic pretensioning can be achieved by virtue of the fact that the inner width of the clamping device is initially less than the outer diameter of the goods to be packaged. The pretensioning is produced by virtue of the fact that the goods to be packaged urge the elastically movable holding strip or the holding tongues outwards. The holding tongues can be formed in particular as holding fins. The clamping device permits effective protection against impacts. If the clamping device is formed as holding tongues, then it is possible in a particularly effective manner for the goods to be packaged fixed by the clamping device to be able to move slightly resiliently in the axial and radial direction relative to the container. In a preferred embodiment, provision is made that the holder is provided with opposed clamping strips or opposed holding tongues, between which the goods to be packaged can be held in a clamping manner.

In an advantageous manner, a multiplicity of holding tongues is arranged on the holder in a row one next to the other. In this case, it is particularly preferred if the holder is provided with two rows of clamping tongues, between which the goods to be packaged can be held in a clamping manner. The holding tongues can be arranged one next to the other in the axial direction of the container. It is particularly preferred if the holding tongues are configured in the manner of a comb.

A further improvement is achieved by virtue of the fact that the actuating device comprises an actuating element, wherein the actuating element and the holding device can assume a rest position and an actuating position with respect to one another, wherein the actuating element in the actuating position opens the holding device in that it enlarges the inner width of the holding device. The actuating element can open the holding device e.g. by virtue of the fact that it moves the clamping device apart so that the inner width between the clamping device is enlarged. Now, a good to be packaged can be moved from the receiving space into the dispenser.

In a particularly advantageous embodiment of the invention, provision is made that the holding device is formed as an insert which is movably inserted in the container body, wherein the insert is movable with respect to the actuating element such that a pressure surface formed on the actuating element cooperates in the actuating position with the holding device and opens same. Preferably, the pressure surface lies in the actuating position against the clamping device and urges same apart. This can be achieved in a particularly favourable manner by virtue of the fact that the insert is rotatable with respect to the container body. In this case, it is sufficient if a rotational movement is effected for a fraction of 360°. The rotational movement moves the holding device to the open position. If the clamping device are formed in an elastic manner, they can then move automatically to the closed position. In the open position, the stacked goods to be packaged can move in the direction of the longitudinal axis of the container so that a good to be packaged can pass from the receiving space into the dispenser.

In accordance with one advantageous embodiment of the invention, provision is made that the actuating element is arranged on the container body. In an advantageous manner, the actuating element comprises an arm which is arranged in the container body. Preferably, the arm is arranged on a base of the container body. The arm can extend in the direction of the longitudinal axis of the container. In particular, the arm can be arranged perpendicularly on the base of the container body. A particularly advantageous design is one in which two such arms are provided. Furthermore, the embodiment of the actuating element as a rib is particularly preferred; said rib can be arranged e.g. on the inner wall of the container body and can extend in the direction of the longitudinal axis of the container body.

In accordance with a further embodiment of the invention, provision can be made that the actuating element is arranged on the holding device. Preferably, the actuating element can be formed as a button, in particular as a push-button, upon actuation of which the holding device is opened. This can be achieved by virtue of the fact that upon actuation of the button the holding device which can be formed in particular as an insert is rotated relative to the container body.

By virtue of the fact that the actuating element or in particular also the holding device comprises a guide portion for lying against the goods to be packaged, which guide portion guides the goods to be packaged in the radial direction, the handling of the container is further improved. Even if the holding device is open, the goods to be packaged remain laterally guided. If the goods to be packaged are arranged as a stack, the guide portion can also render it possible to maintain the stacked arrangement even when the holding device is open. In particular, it is possible to prevent the goods to be packaged from tumbling about in a disordered manner when the holding device is open which could adversely affect function of the dispenser and cause damage to the goods to be packaged. Nevertheless, the guide portion can allow the goods to be packaged to move in the direction of the longitudinal axis of the container when the holding device is open, so that a good to be packaged is conveyed into the dispenser. The guide portion can be configured e.g. in the shape of a portion of an arc of a circle. This provides inter alia effective guidance of circular tablets. In an advantageous manner, two of the guide portions are provided opposite one another. In a particularly practical manner, each arm can comprise a guide portion.

Handling is then particularly simple if the dispenser comprises a chamber in which at least one good to be packaged can be received without being held by the holding device in the closed position thereof. In this case, it is preferred that in each case only one good to be packaged can be received in the chamber, in order in this manner to allow individual goods to be packaged to be dispensed. The goods to be packaged can be removed manually from the chamber e.g. after removal of a cover. Alternatively, it is possible to dispense the good to be packaged from the chamber outwards using a device. It is particularly advantageous if the good to be packaged in the chamber is outside the effective region of the clamping device so that it can be removed without any problem while the holding device is in the closed position.

A further improvement is achieved by a cover which closes a container opening of the container body and/or covers the chamber of the dispenser. The cover can be formed as a lid. In this case, provision can be made that the cover can be opened, in order to remove the at least one good to be packaged from the chamber. Moreover, the cover can render it possible for a good to be packaged to be able to fall into the chamber under the effect of gravitational force when the holding device is open, wherein the cover prevents the goods to be packaged from falling out.

Handling is simplified further if a catch acts between the cover and the holding device and transfers a movement of the cover, in particular a rotation of the cover, relative to the container body to the holding device. In this manner, rotation of the cover can serve to rotate the holding device which is formed in particular as an insert, in order to move the holding device to the open position. The catches can be e.g. projections, in particular knobs, which are provided on the cover and/or on the holding device and are moved into engagement with one another.

A further improvement is achieved by virtue of the fact that the container body is provided with a stop which cooperates with a mating stop surface of the holding device, in order to limit a movement of the holding device relative to the container body. This also increases the reliability in operation. Furthermore, the catches can be advantageously formed as latching device which permit a continuation of the movement of the cover relative to the container body if the stop cooperates with the mating stop surface. In this manner, the cover can optionally be rotated in any manner, without the holding device and the actuating device assuming a non-designated position. Moreover, during operation the latching device can produce a clicking noise which permits intuitive operation and signals to the user that the cover has been moved to the required extent.

In a particularly proven embodiment of the invention, provision is made that the container body forms with the actuating device a first synthetic material injection-moulded part, the holding device formed as an insert forms a second synthetic material injection-moulded part and/or the cover forms a third synthetic material injection-moulded part. Each of these parts can be produced in a cost-effective manner during the course of injection-moulding.

Further exemplary features, advantages and possible applications of the present invention will be apparent from the description hereinafter of exemplified embodiments with reference to the drawing. All of the described and/or figuratively illustrated features form the subject matter of the invention in their own right or in any meaningful combination, even irrespective of the combination in individual exemplified embodiments, in individual claims or dependency references thereof.

DETAILED DESCRIPTION

Figure 1:
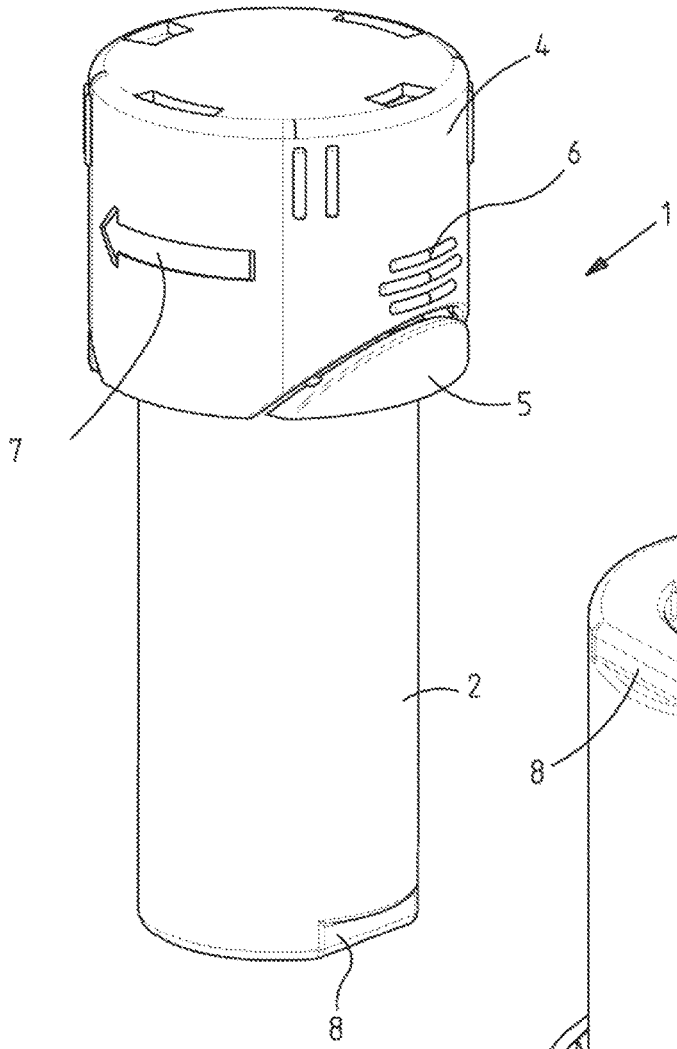
FIG. 1 shows a perspective view of the container in accordance with the invention from the side.
Figure 2:
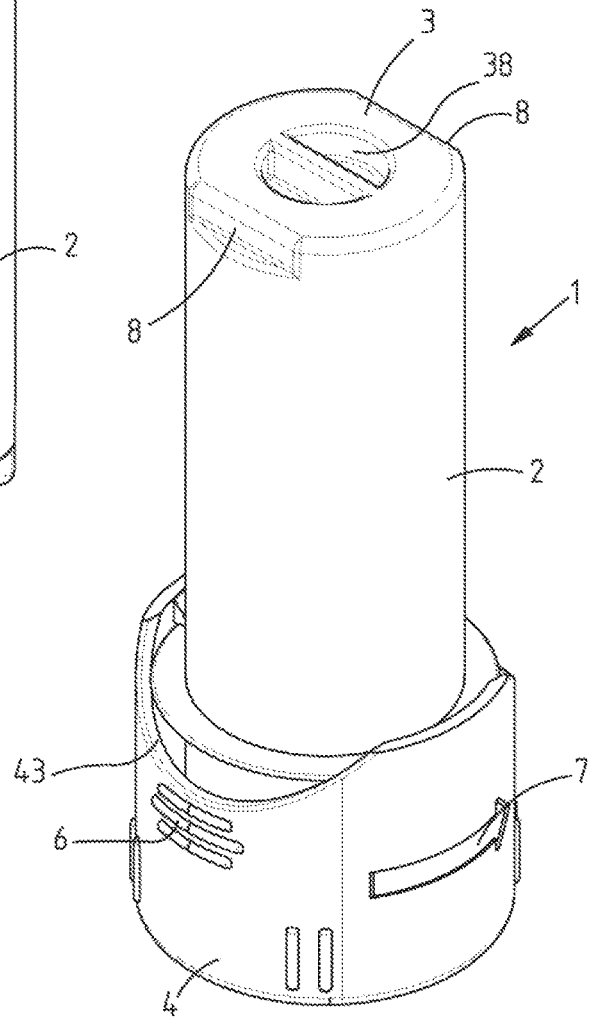
FIG. 2 shows a perspective view of the container of FIG. 1 from below.

FIGS. 1 and 2 show a container 1 which comprises a container body 2. In the illustrated exemplified embodiment, the container body 2 comprises a substantially cylindrical contour. The container body 2 is closed at one end by the base 3. This can be seen particularly clearly in FIG. 2 which shows the container in a perspective view looking onto the base 3.

Furthermore, the container 1 comprises a cover 4. This is formed as a lid and closes the container body 2 on its side opposite the base 3.

The cover 4 is provided with tamper-evident lock 5. This is formed as a tear tab, wherein the cover 4 can be opened only after the tamper-evident lock 5 has been removed. FIG. 2 shows the cover 4 with the tamper-evident lock removed. Furthermore, a child safety lock is provided. For this purpose, in the case of the illustrated exemplified embodiment the cover 4 is provided with two opposite pressure surfaces 6 wherein the child safety lock can be unlocked by applying pressure onto the pressure surfaces 6.

Furthermore, the cover 4 has an arrow 7 provided thereon which indicates in which direction the cover 4 is to be rotated relative to the container 2.

FIG. 2 also clearly shows that the container body 2 comprises on its outer side two opposite positioning surfaces 8 which are formed in a planar manner. The positioning surfaces 8 can be used for orienting the container bodies 2 during assembly or filling. Furthermore, the base 3 is provided with two recesses 38 which are separated by a web and likewise permit positioning.

Figure 3:
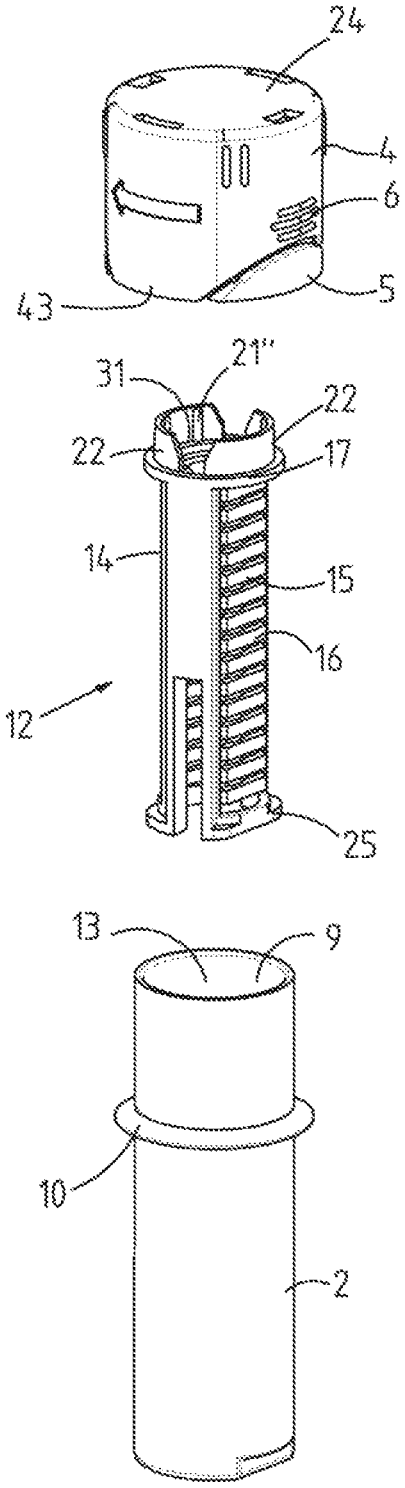
FIG. 3 shows an exploded view of the container of FIG. 1.

FIG. 3 shows an exploded view of the container. In this case, it is possible to clearly see the cylindrical container body 2 which comprises a container opening 9 on its side opposite the base 3. A circumferential bead 10 is provided on the outer side of the container body 2. As will become more apparent from the following figures, this bead can cooperate with two latching elements 11 of the cover 4, in order to secure the cover 4 on the container body. The cover 4 is provided with a child safety lock 43 which prevents the cover 4 from being removed unintentionally. In the case of the illustrated exemplified embodiment, the child safety lock 43 is produced by virtue of the fact that the cover 4 can only be opened if the pressure surfaces 6 are pressed at the same time and as a result the cover 4 is deformed such that the latching elements 11 no longer engage behind the bead 10.

The container body 2 forms in its interior a receiving space 13 for a plurality of goods to be packaged. Said goods to be packaged can be in particular pressed bodies. The described container is particularly suitable for tablets. However, it can also be used for other products, such as foods, tabs etc.

FIG. 3 also shows the holding device 12 for fixing the goods to be packaged in the receiving space 13. In the case of the illustrated embodiment, the holding device 12 is formed as an insert 14 which can be inserted into the container body 2.

Figure 3A:
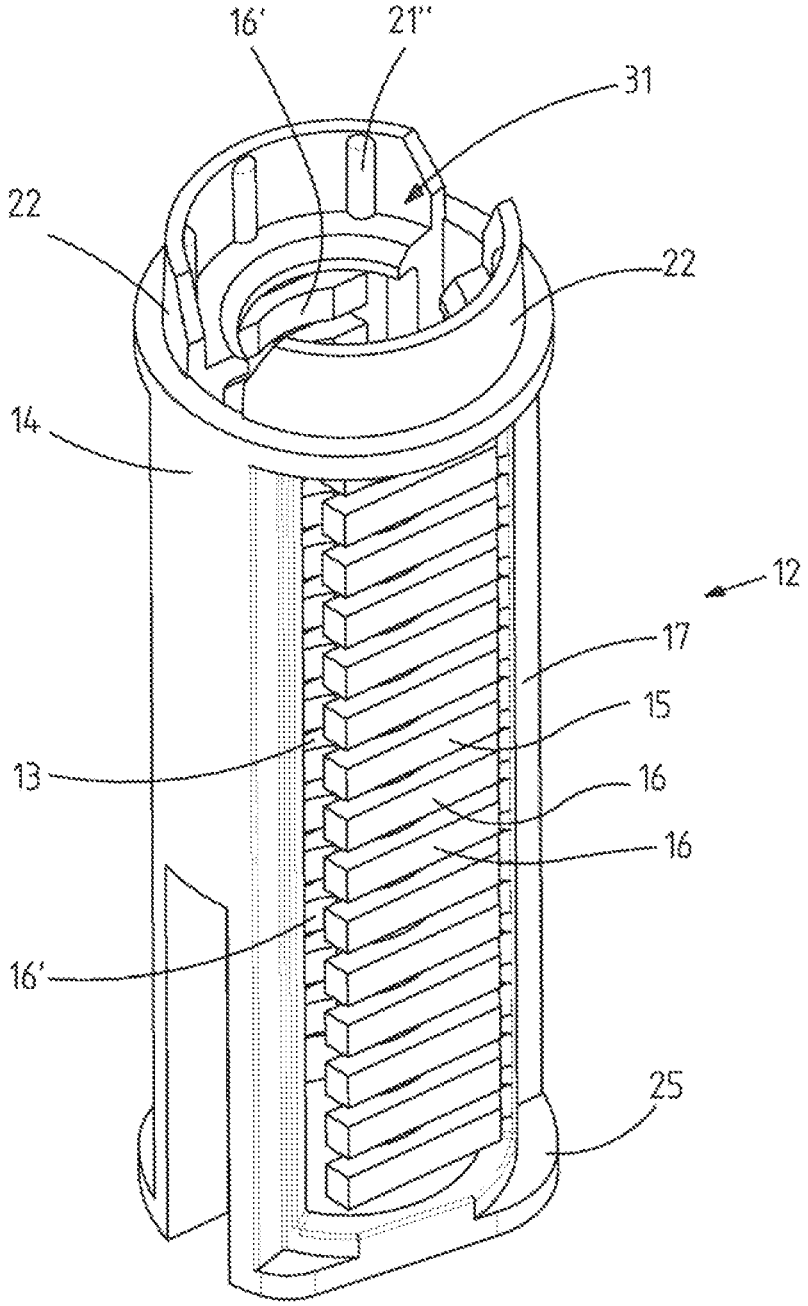
FIG. 3*a* shows a perspective view of the holding device.

Details of the holding device 12 can be seen particularly clearly in FIG. 3*a*. It is evident in this case that the holding device 12 comprises clamping device 15 for holding the goods to be packaged in a clamping manner. In the case of the illustrated exemplified embodiment, the clamping device 15 comprises holding tongues 16. In the case of the illustrated exemplified embodiment, a multiplicity of holding tongues 16 arranged next to one another is provided. The holding tongues 16 are fastened on one side thereof in an elastically movable manner to an elongate holder 17. On the opposite side, the holding tongues 16 comprise a free end. In the case of the illustrated exemplified embodiment, two oppositely arranged rows of holding tongues 16. 16' are provided which are formed in a corresponding manner but face in opposite directions. The goods to be packaged can be received in a clamping manner between the holding tongues 16 and 16'. The holding device is configured to hold a stack of goods to be packaged. This is explained in greater detail in the following figures.

The container 1 also comprises an actuating device 18 which renders it possible to move the holding device 12 from the closed position to an open position. In the case of the illustrated exemplified embodiment, the actuating device 18 is arranged in the interior of the container body 2. This is particularly clearly apparent from FIG. 3*b* which shows a diagonal view from above into the container body. The actuating device 18 comprises two actuating elements 19 and 19'. These elements are arranged on the base 3 of the container body 3. The actuating elements 19, 19' are each formed as an arm and extend in parallel with the longitudinal axis of the container body 2. Each actuating element 19, 19' also comprises a guide portion 20 which is spaced apart from the inner contour of the container body 3. The guide portion 20 has a shape adapted to the outer contour of the goods to be packaged. In the illustrated example, the guide portion 20 has the shape of a portion of an arc of a circle. A web 44 which faces outwards is provided on the outer side of the guide portion 20. The guide portion 20 and web 44 are formed having a T-shaped cross-section. Towards the base 3, the web 44 has an increasing length and is connected to the container body 2.

In the case of the illustrated exemplified embodiment, two actuating elements 19, 19' are provided opposite one another. The radially inwardly facing surfaces of the actuating elements 19, 19' guide the goods to be packaged in the radial direction. However, the inner width between the guide portions 20 is slightly larger than the diameter of a good to be packaged so that the goods to be packaged can move in the axial direction between the guide portions 20 if the holding device 12 is moved to the open position.

Figure 3B:
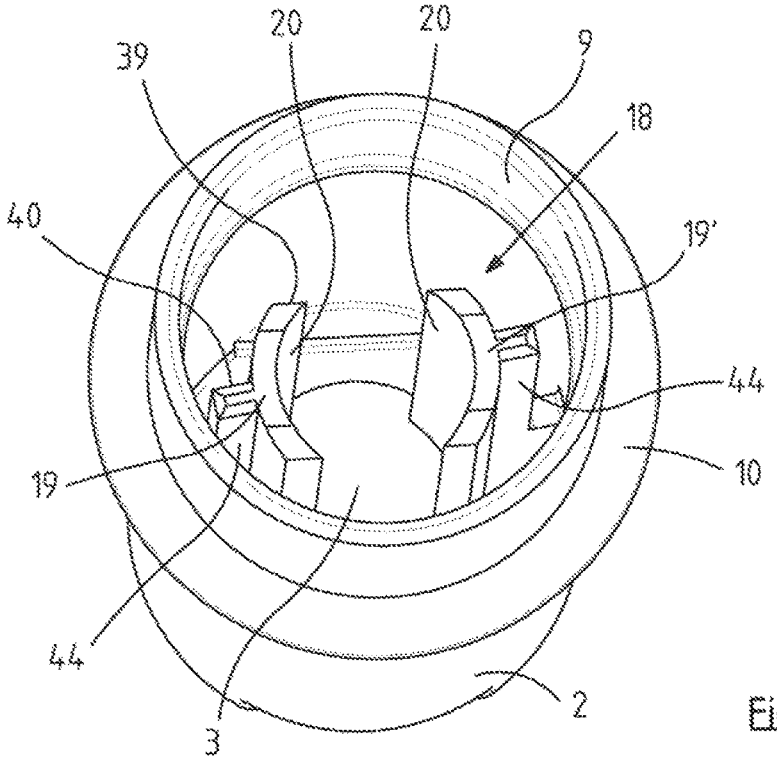
FIG. 3*b* shows a perspective view of the container body.
Figure 3C:
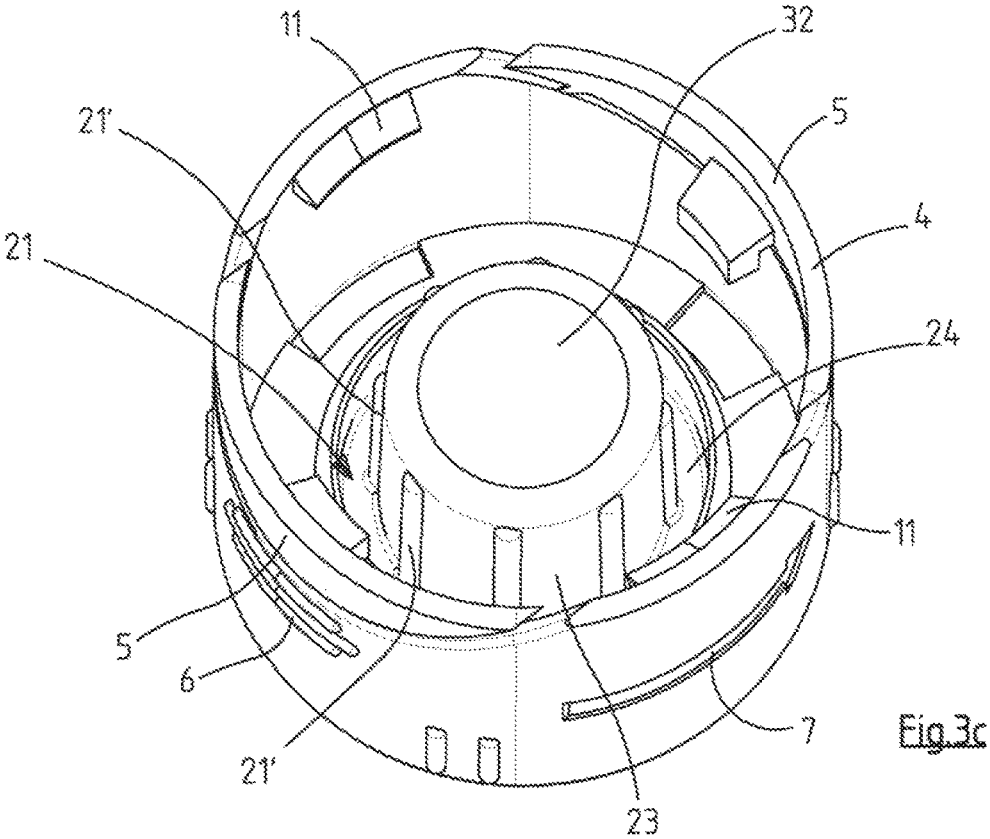
FIG. 3*c* shows a perspective view of the cover.

The cover 4 is illustrated more precisely in FIG. 3*c*. A perspective view looking into the cover is shown. The cover 4 is provided so as to be freely rotatable on the container body 2. In this case, the latching element 11 which latches behind the bead 10 prevents the cover 4 from being removed unintentionally. A rotation of the cover 4 is transferred to the insert 14. For this purpose, a catch 21 is provided which comprises cams 21' on the cover 4. Corresponding cams 21" are provided on the insert 14 (cf. FIG. 3*a*). In the illustrated case, 8 cams 21" are provided distributed over the periphery. During a rotation of the cover 4, the cams 21' come to lie against the cams 21". A rotation of the cover 4 is transferred in this manner to the insert 14. However, during a rotation of the cover 4 the insert 14 is co-rotated only to a small extent, namely until the holding device 12 is open. If the rotation of the cover 4 is continued, the cams 21' of the cover slide past the cams 21" of the insert. In order to facilitate this, the cams 21" of the insert are provided on the inner side of two oppositely arranged tabs 22 which are arranged on the holder 17 and allow the cams 21" to yield elastically (cf. FIG. 3*a*). The cams 21', 21" form in this manner a latching device which permits a continuation of the movement of the cover 4 relative to the container body 2 if—as explained in greater detail hereinafter—the stop 40 cooperates with the mating stop surface 41.

The cams 21' of the cover 4 are formed on the outer side of a cylindrical actuating portion 23 which extends perpendicularly upwards from the lid base 24.

FIG. 3*b* also shows particularly clearly the arrow 7, the tamper-evident lock 5 and the latching element 11.

Figure 4:
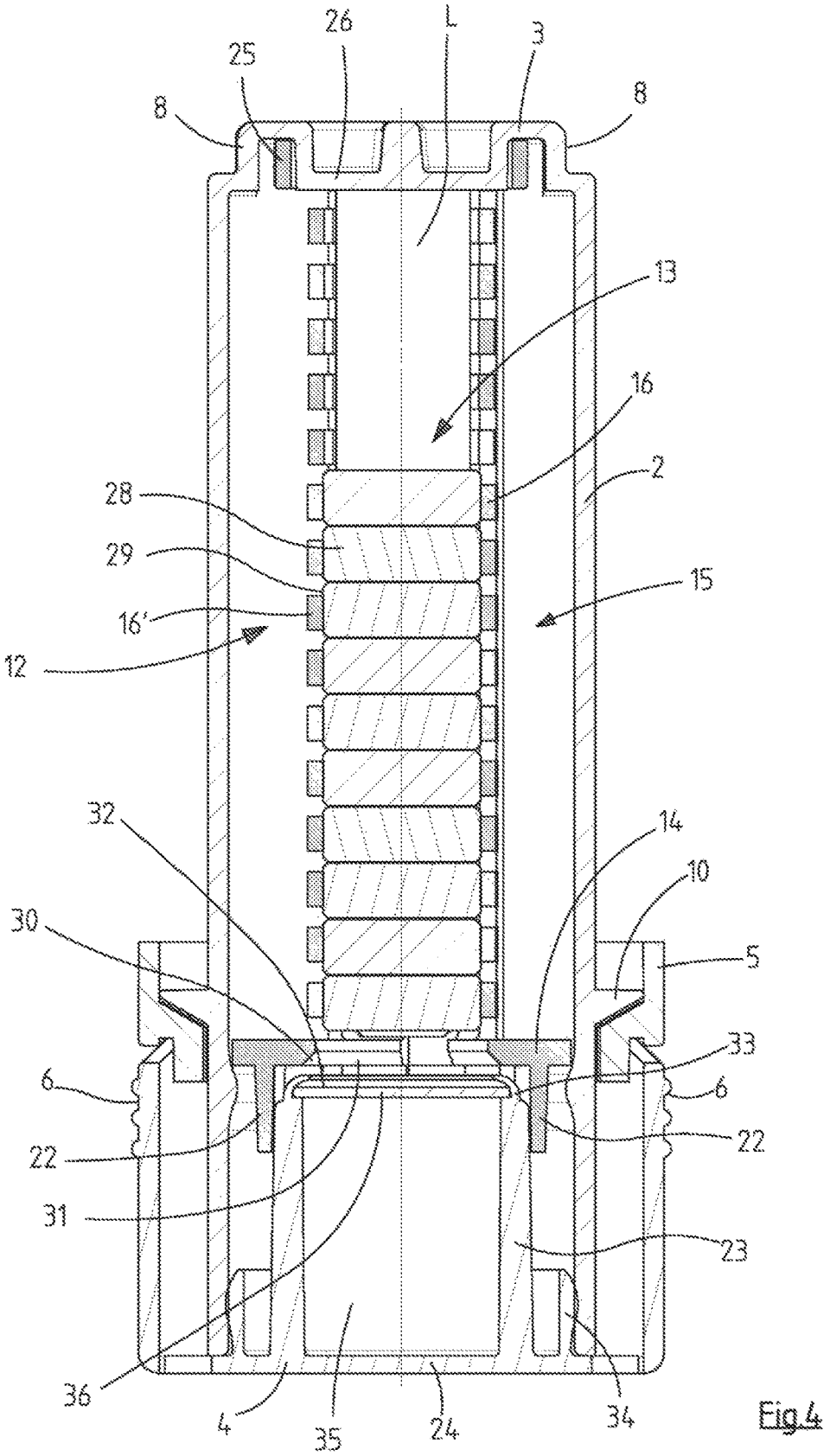
FIG. 4 shows a sectional view along the longitudinal axis of the container of FIG. 1 with the holding device in the closed position.
Figure 4A:
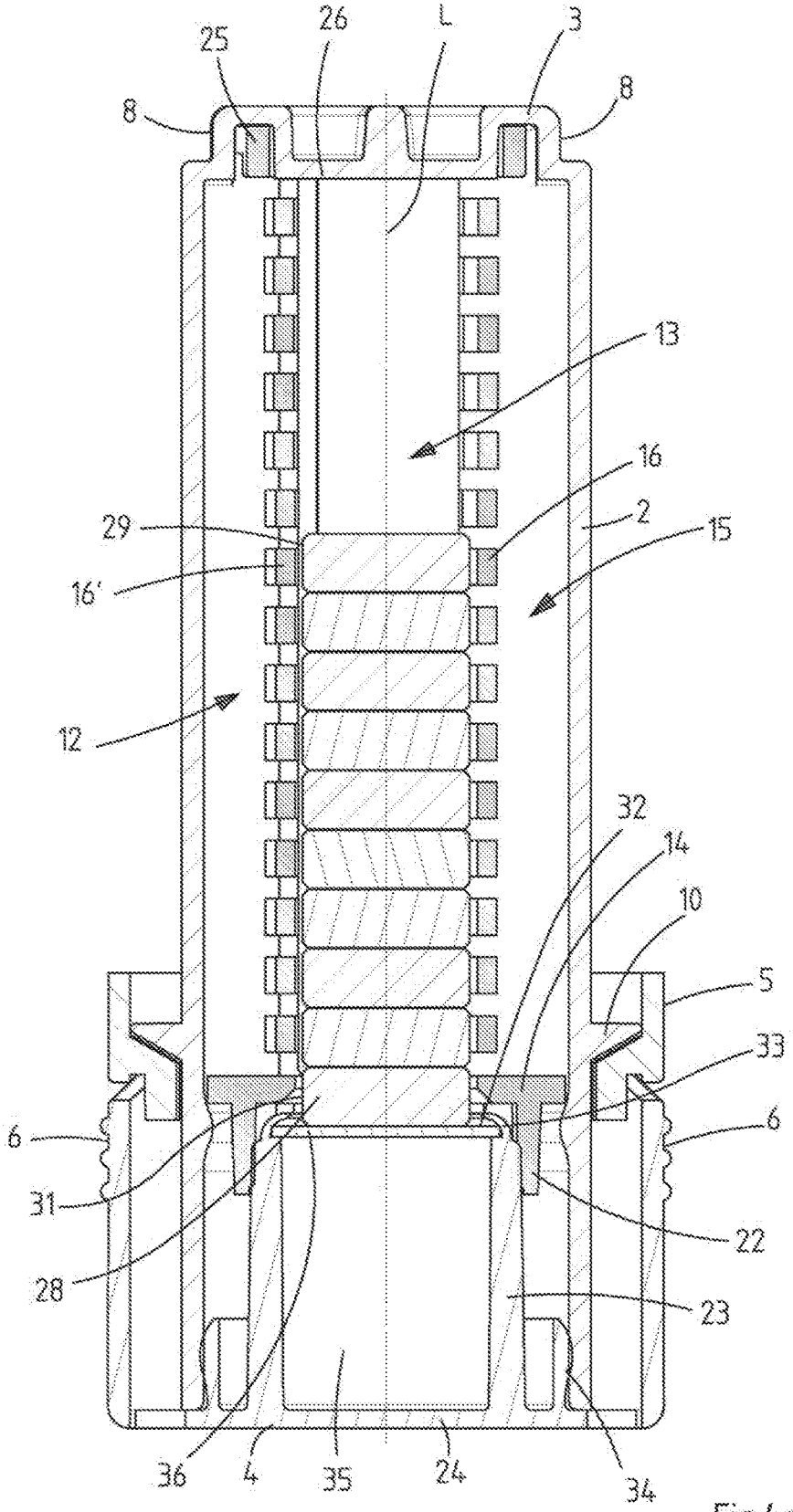
FIG. 4*a* shows a sectional view along the longitudinal axis of the container of FIG. 1 with the holding device in the open position.
Figure 4B:
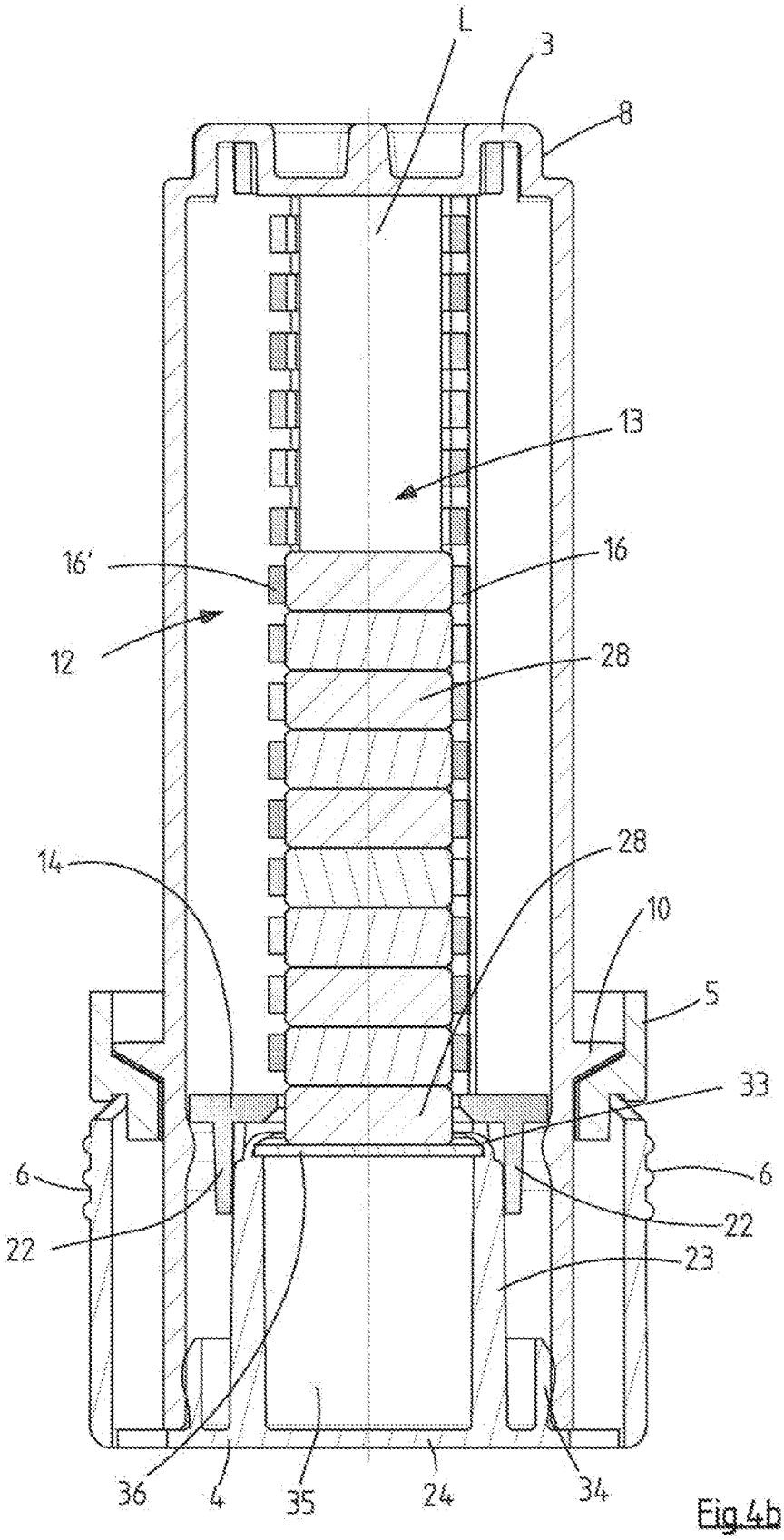
FIG. 4*b* shows a sectional view along the longitudinal axis of the container of FIG. 1 with the holding device in the closed position.
Figure 4C:
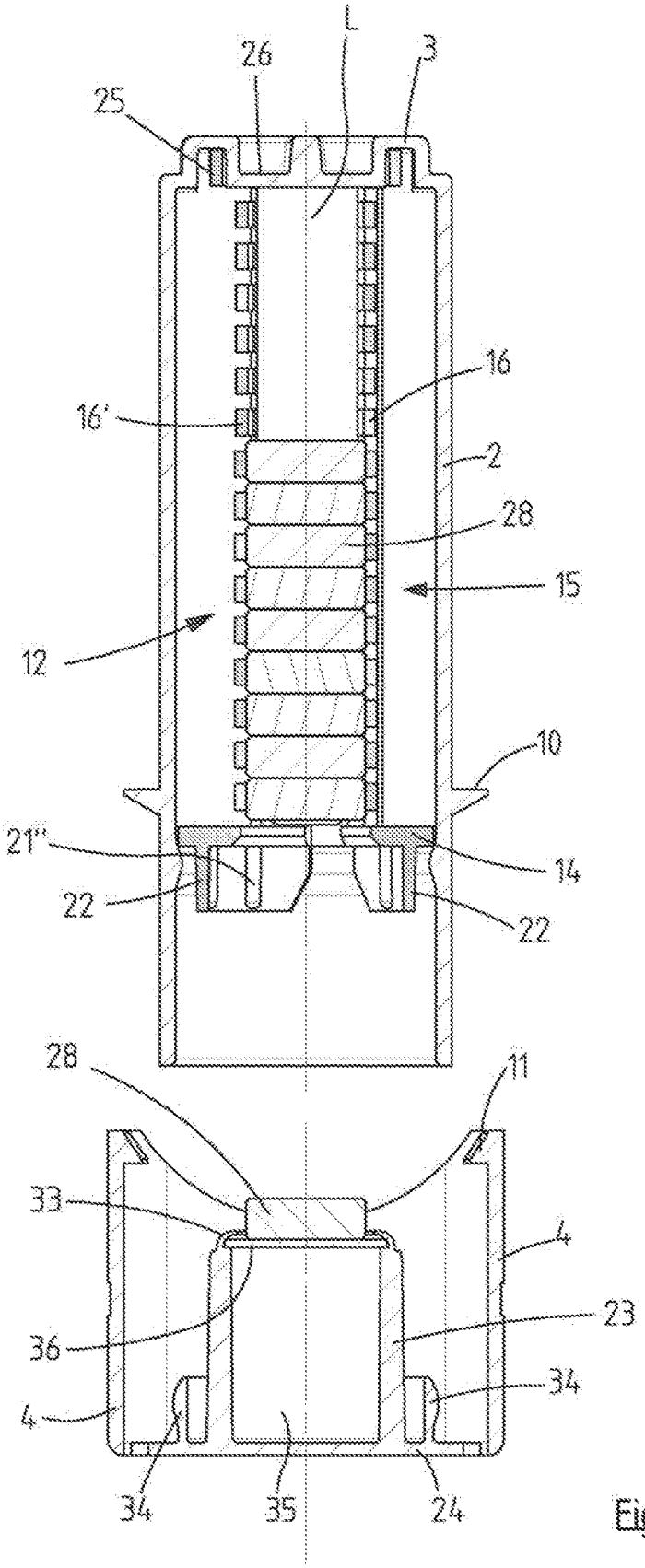
FIG. 4*c* shows a sectional view along the longitudinal axis of the container of FIG. 1 with the cover removed.

FIGS. 4 to 4*c* each show a sectional view along the longitudinal axis L of the container 1 and illustrate the mode of operation. These figures also show the goods to be packaged received in the receiving space.

FIG. 4 clearly shows the holding device 12 which is configured as an insert 14 and is received in the container body 2. The insert 14 lies with the support portion 25 on the container base 3. In this case, a positive connection is established between the container base and the holding device 12 by means of an inwardly drawn portion 26 of the container base 3, said positive connection preventing a movement transversely with respect to the longitudinal axis L of the container 1.

FIG. 4 also clearly shows that a multiplicity of goods to be packaged 28 stacked one above the other is received in the container 1. In the illustrated example, 10 goods to be packaged 28 are provided. In the illustrated example, the goods to be packaged 28 have a cylindrical shape with a circular peripheral surface 29. The individual goods to be packaged 28 are held by the holding tongues 16 of the clamping device 15. These lie in the illustrated closed position against the peripheral surfaces 29 of the goods to be packaged 28. In the case of the illustrated exemplified embodiment, each of the goods to be packaged 28 is held on opposite portions of the peripheral surface 29 by means of a holding tongue 16 or 16' in each case. The clamping device 15 are inwardly pretensioned which generates the clamping force. For this purpose, the inner width between the clamping device 15 is initially slightly smaller than the diameter of the goods to be packaged 28. If goods to be packaged 28 are arranged between the clamping device 15, the clamping device 15 are bent slightly outwards in an elastic manner, thus producing the clamping force.

FIG. 4 also shows that the container 1 comprises a dispenser 30. This allows separated goods to be packaged 28 to be removed. The dispenser 30 comprises a chamber 31 which is initially empty after the container 1 has been filled.

The filled container 1 preferably leaves the factory in this state. All of the goods to be packaged 28 are fixed by the holding device 12.

FIG. 4*a* shows the same container with the holding device 12 open. In this case, the holding device 12 is opened by the actuating device 18. For this purpose, the clamping device 15 are moved with the holding tongues 16 in the radial direction outwards, wherein the inner width is enlarged between the clamping device 15. The goods to be packaged 28 are released in this manner. Nevertheless, in this position the goods to be packaged 28 are guided by the opposite guide portions 20. Therefore, the goods to be packaged 28 can move in the direction of the longitudinal axis L. At the same time, the goods to be packaged 28 are precluded from moving to an undesired extent in the radial direction. This prevents the goods to be packaged 28 from assuming an undesired position in the receiving space 13.

When the holding device 12 is open, one of the goods to be packaged 28 can be moved into the chamber 31 of the dispenser 30. This occurs under the effect of gravitational force in that the container 1 is held with the cover 4 downwards. The good to be packaged 28 in the chamber is now located outside of the holding device. If the holding device is closed once again, as illustrated in FIG. 4*b*, the goods to be packaged 28 are then fixed. Only the good to be packaged received in the chamber 31 is not grasped by the holding device 12.

When the cover 4 is removed for the first time, the tamper-evident lock 5 is removed by tearing. Now, the child safety lock 43 can be unlocked and the latching elements 11 on the cover 4 can be moved to a position in which they no longer engage behind the bead 10 on the container body 2. After the cover 4 has been removed, the position illustrated in FIG. 4*c* is achieved. If the container 1 is removed with, as illustrated, the cover 4 facing downwards, the good to be packaged 28 lies on a support surface 32 which is formed on the cover 4. The support surface 32 is allocated support elements 33 which prevent the good to be packaged from sliding laterally.

However, it is also possible to remove goods to be packaged 28 from the dispenser 30 if the container is opened with the cover facing upwards (not illustrated). Then, the good to be packaged 28 initially continues to lie in the chamber 31. By rotating the container body 2, the good to be packaged 28 can be dispensed from the chamber 31 outwards. In this case, the goods to be packaged 28 remaining in the receiving space 12 remain in the container body 2, as they are fixed by the holding device 12.

FIGS. 4 to 4*c* also clearly show that the cover 4 is formed as a lid which closes the container body 2. In this case, the cover 4 is provided with a circumferential sealing bead 34 which comes to lie against the container body 2. In the case of the illustrated exemplified embodiment, the sealing bead 34 is in contact with the inner side of the container body 2 if the cover 4 is placed onto the container body 2. Furthermore, a drying agent chamber 35 is provided in the cover 4. This chamber is provided on its side facing towards the container body 2 with a cover 36 consisting of a moisture-permeable material, such as e.g. a paperboard or a synthetic material grid. The cover 36 of the drying agent chamber 35 forms, with its side facing the chamber 31, the support surface 32.

Furthermore, FIGS. 4 to 4*c* show that the cover 4 is provided with the actuating portion 23 which can be brought into engagement with the holding device 12. In the case of the illustrated exemplified embodiment, the actuating portion 23 has a cylindrical shape and is arranged on the inner side of the cover 4. The actuating portion 23 inwardly defines the drying agent chamber 35. The cams 21' are arranged on its peripheral surface. When the cover 4 is placed in position, the actuating portion 23 extends as far as the holding device 12 and lies against same. In the case of the illustrated exemplified embodiment, the actuating portion 23 is received between the tabs 22.

The cover 4 can be rotated relative to the insert 14 until the cams 21' come to lie against the cams 21". During a further rotation, the cover 4 then entrains the insert 14. As soon as the insert 14 is prevented from rotating further by means of a stop 40 which will be explained in greater detail hereinafter, the cams 21' and 21" can slide past one another. This is facilitated by an elasticity of the tabs 22.

FIGS. 4 to 4*c* also show that the goods to be packaged 28 are held by the holding device 12 at a spaced interval with respect to the container body 2. In this manner, it is possible to reduce the transfer of impacts, which act upon the container body 2 e.g. during transportation, to the goods to be packaged 28. The elastic clamping device 15 permit a certain elastic mobility both in the direction of the longitudinal axis L and in a direction perpendicular thereto.

Figure 5A:
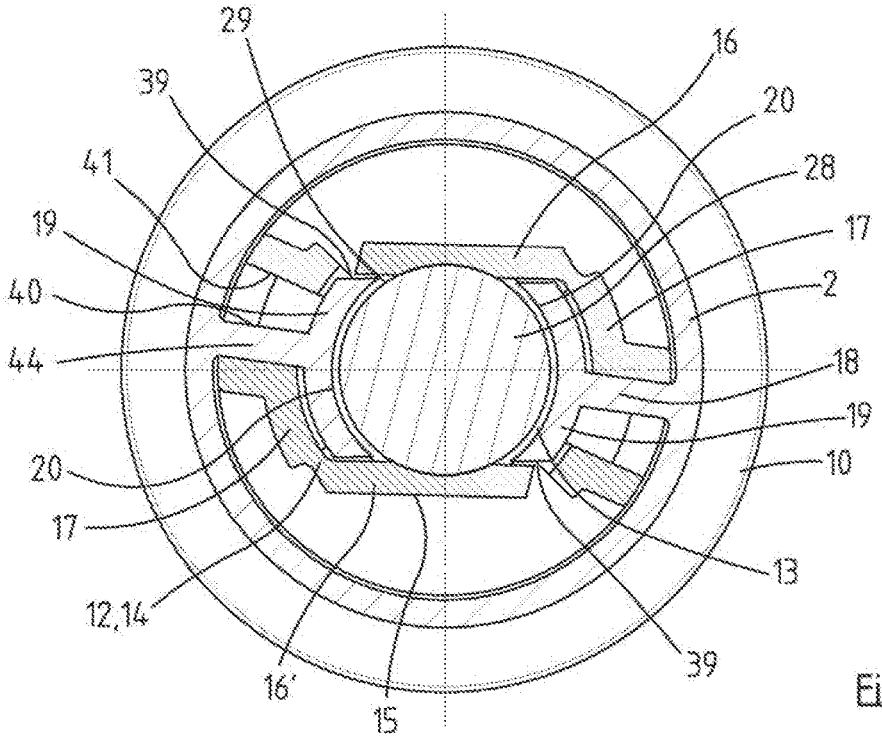
FIG. 5*a* shows a cross-sectional view of the container of FIG. 1 with the holding device in the closed position.
Figure 5B:
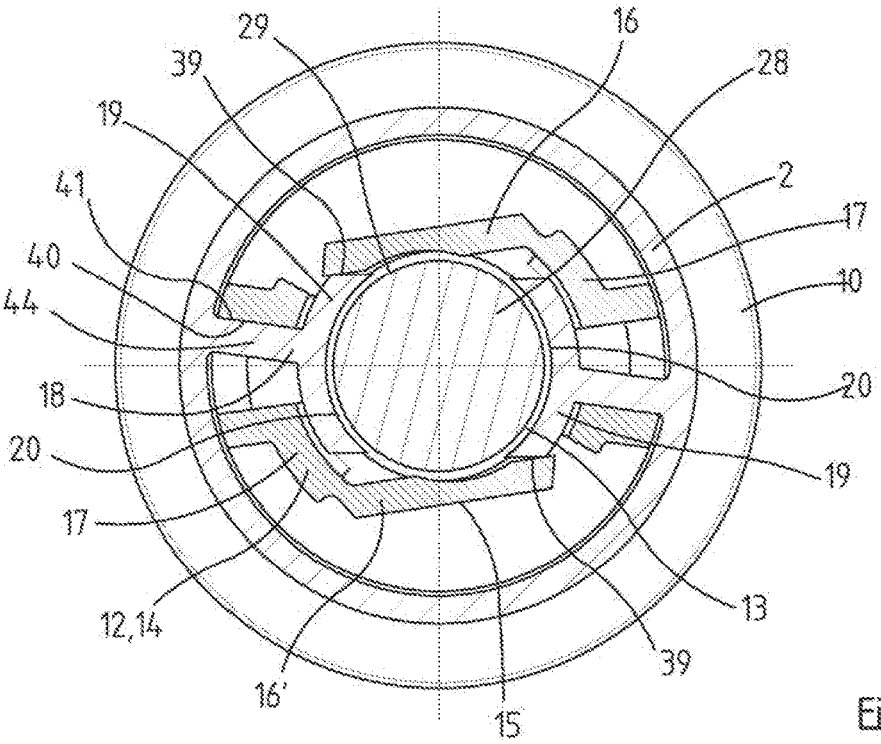
FIG. 5*b* shows a cross-sectional view of the container of FIG. 1 with the holding device in the open position.

FIGS. 5*a* and 5*b* which show a cross-section of the container illustrate how the holding device 12 can be moved from the closed position to the open position by the actuating device 18. FIG. 5*a* shows the holding device 18, which is already shown in FIG. 3*b*, in the closed position. The clamping device 15 apply a clamping force in the radial direction inwards to the peripheral surface 29 of the goods to be packaged 28. In order to distribute the forces effectively, the contact surface of the clamping device 15 is adapted to the contour of the good to be packaged 28. The actuating device 18 is initially located in its rest position, as illustrated in FIG. 5*a*. By rotating the holding device 12 with the insert 14 relative to the container body 2, the actuating device 18 assumes its actuating position. In this position, the actuating element 19 opens the holding device 12 by increasing the inner width of the holding device 12. This can be clearly seen in FIG. 5*b*. The actuating element 19 comprises a pressure surface 39 which in the actuating position comes to lie against the clamping device 15 and presses same in the radial direction outwards. The movement between the holding device 12 and the container body 2 is limited. This avoids any undesired deformation of the clamping device 15. For this purpose, the container body 2 comprises a stop 40 which in the actuating position comes to lie against the mating stop surface 41. The stop 40 is formed by the web 44. As described above, a rotation of the insert 14 is achieved by virtue of the fact that the cover 4 is rotated relative to the container body 4, until the cams 21' and 21" come to lie against one another and entrain the insert 14. However, as soon as the stop 40 comes to lie against the mating stop surface 41, a further rotation of the holding device 12 in the same direction is no longer possible. Nevertheless, if the cover 4 is rotated further, the cams 21' and 21" slide past one another so that the insert 14 then becomes free. Under the effect of the pretensioning of the clamping device 14, the clamping device 14 move in the radial direction inwards, until they then come to lie against the goods to be packaged 28. Therefore, the device automatically returns to the position shown in FIG. 5*a*. In order to deliver one of the goods to be packaged 28 from the receiving space 13 into the chamber 31, it is sufficient to rotate the cover 4, until the cams 21' and 21" slide past one another and the clicking noise generated thereby can be heard. This confirms that the holding device 12 has been opened and therefore one of the goods to be packaged 28 was able to fall into the chamber 31.

Figure 6A:
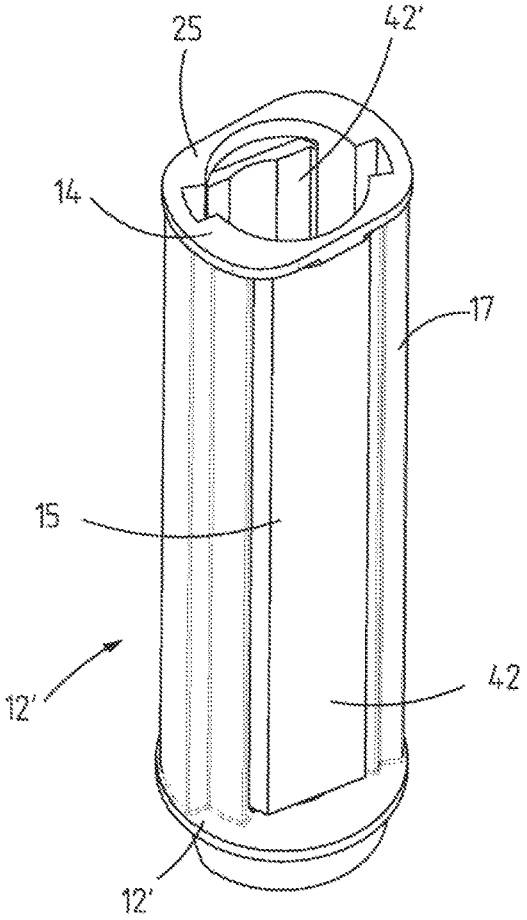
FIGS. 6*a* and 6*b* show a perspective view of an alternative embodiment of the holding device.
Figure 6B:
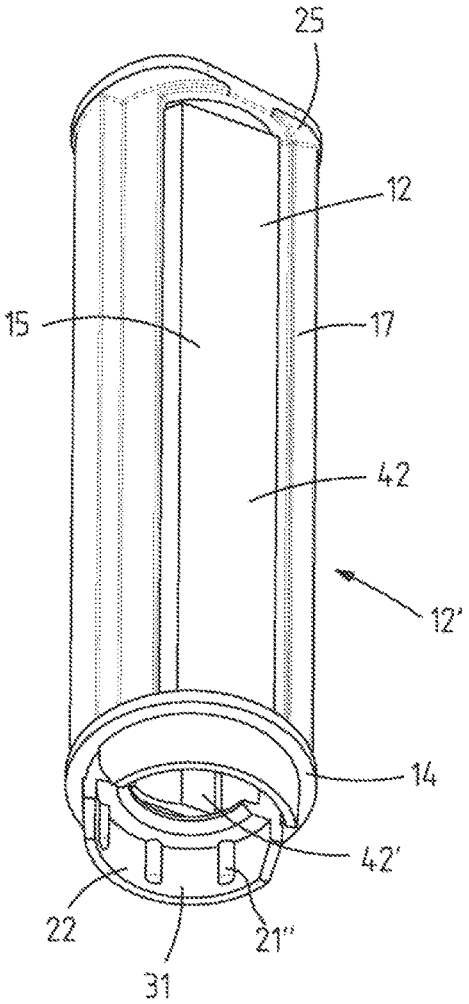

FIGS. 6*a* and 6*b* show an alternative embodiment of the holding device 12'. FIG. 6*a* shows a view looking onto the support portion 25, whereas FIG. 6*b* shows a view looking onto the chamber 31 and the tabs 22. The holding device 12' is substantially identical to the holding device 12 and can be used in the previously described container 1 instead of the holding device 12. Where the holding device 12' corresponds to the holding device 12, the above description of the holding device 12 applies accordingly. Parts having an identical function are designated by the same reference numerals. However, the holding device 12' differs in that the clamping device 15 do not comprise a row of holding tongues. Instead, two holding strips 42, 42' are provided. The holding strips 42 are held elastically on the holder 17 in precisely the same way as the holding tongues 16. The holding strips 42 are fastened to the holder 17 in an elastically movable manner and could apply a clamping force in the radial direction inwards to the peripheral surface 29 of the goods to be packaged 28.

The container body 2 comprising the actuating device 18 can be produced as a first synthetic material injection-moulded part. The holding device 12 (or 12') which is formed as an insert 14 can be formed as a second injection-moulded part. The cover 4 can be formed as a third synthetic material injection-moulded part. By reason of the small number of parts, the production and assembly costs are low. Nevertheless, in spite of the small number of parts, a container can be provided which not only securely holds or contains the goods to be packaged but also comprises a dispenser which allows goods to be packaged to be removed conveniently and safely.

FIGS. 7*a* to 8*k* show two further embodiments of the container which are designated by the reference numerals 1" and 1'". The containers 1" and 1'" and the components thereof are formed substantially like the container 1 or the components thereof described in FIGS. 1-6*b*. Therefore, in order to avoid repetition we refer to the description in conjunction with FIGS. 1-6*b* which shall apply accordingly to the embodiments of FIGS. 7*a* to 8*k*. Parts having an identical function are designated by corresponding reference numerals. We will explain the substantial differences hereinafter.

Figure 7A:
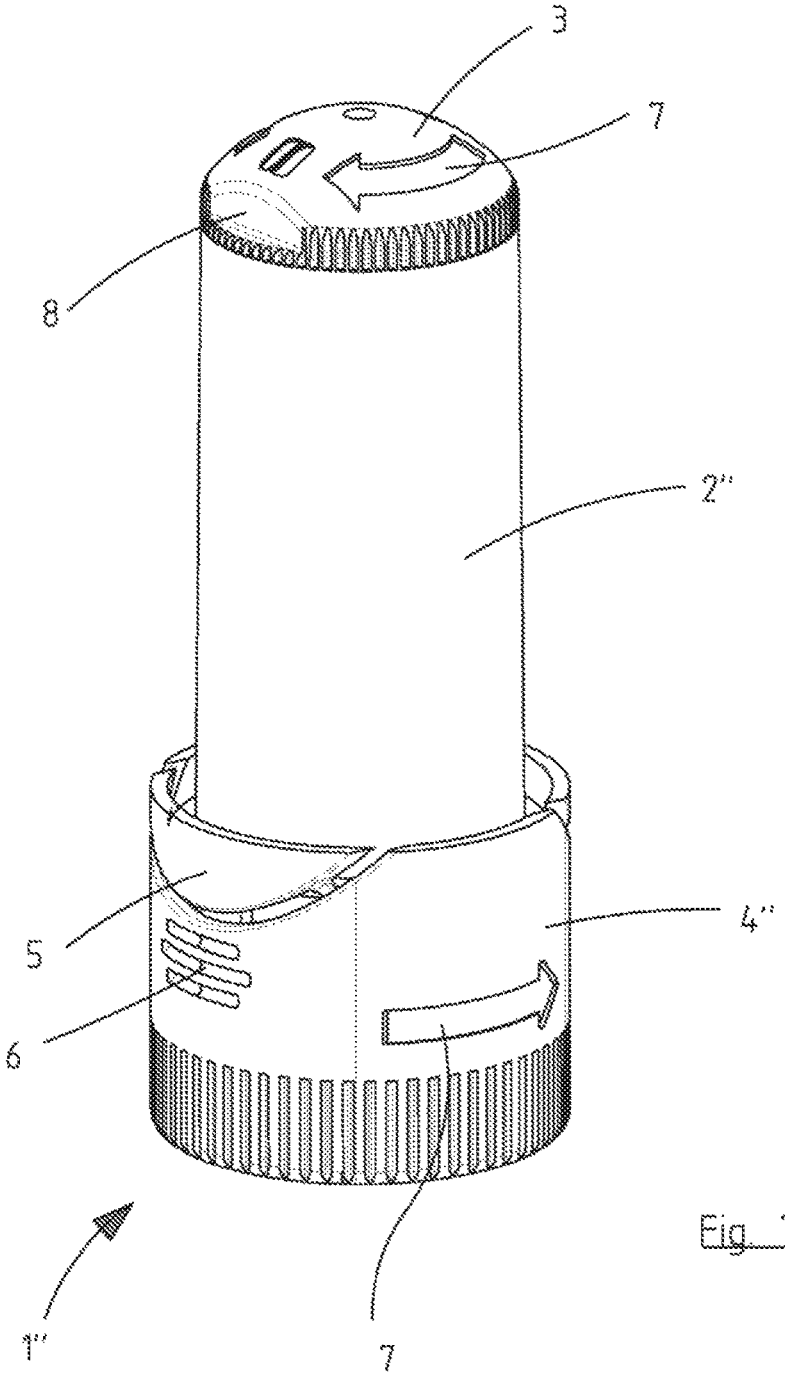
FIGS. 7*a*-7*j* show views of a further embodiment of the container.
Figure 7B:
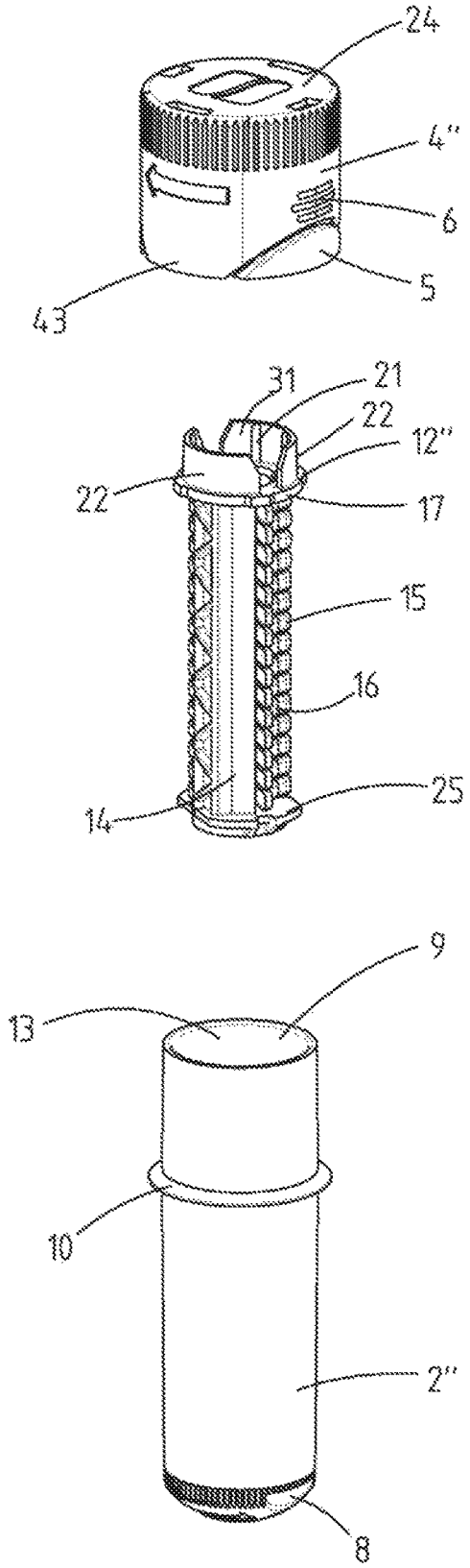
Figure 7C:
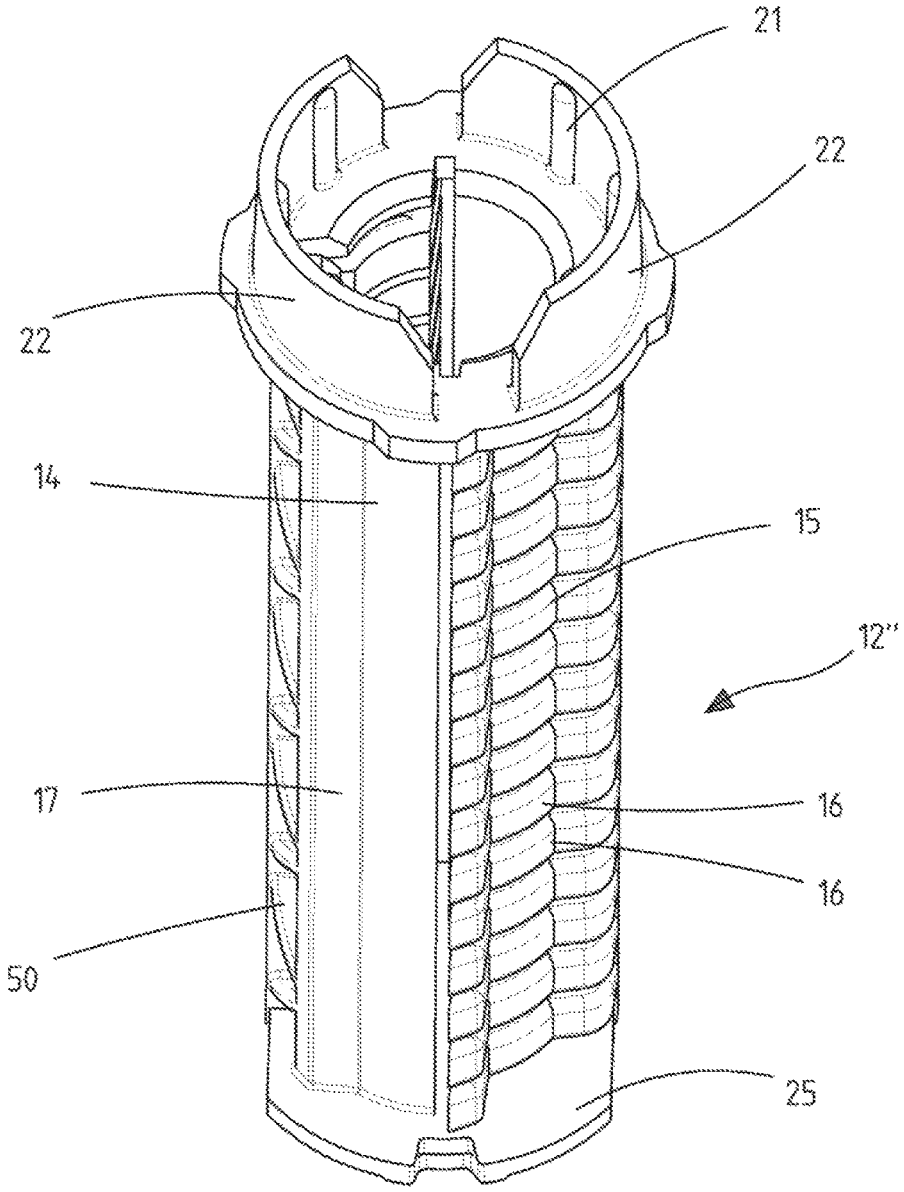
Figure 7D:
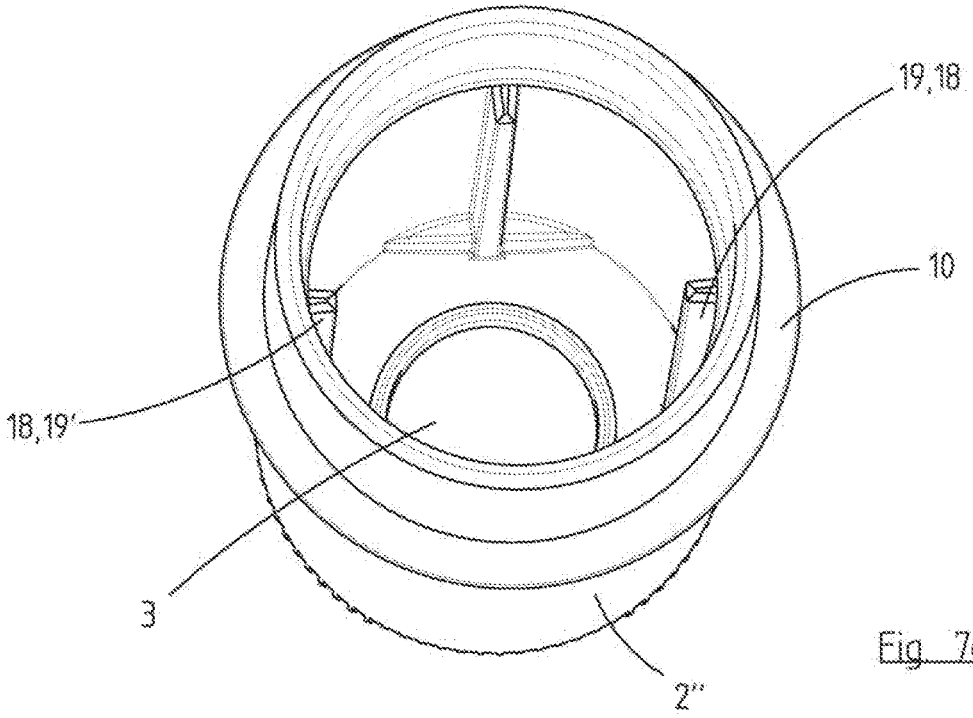
Figure 7E:
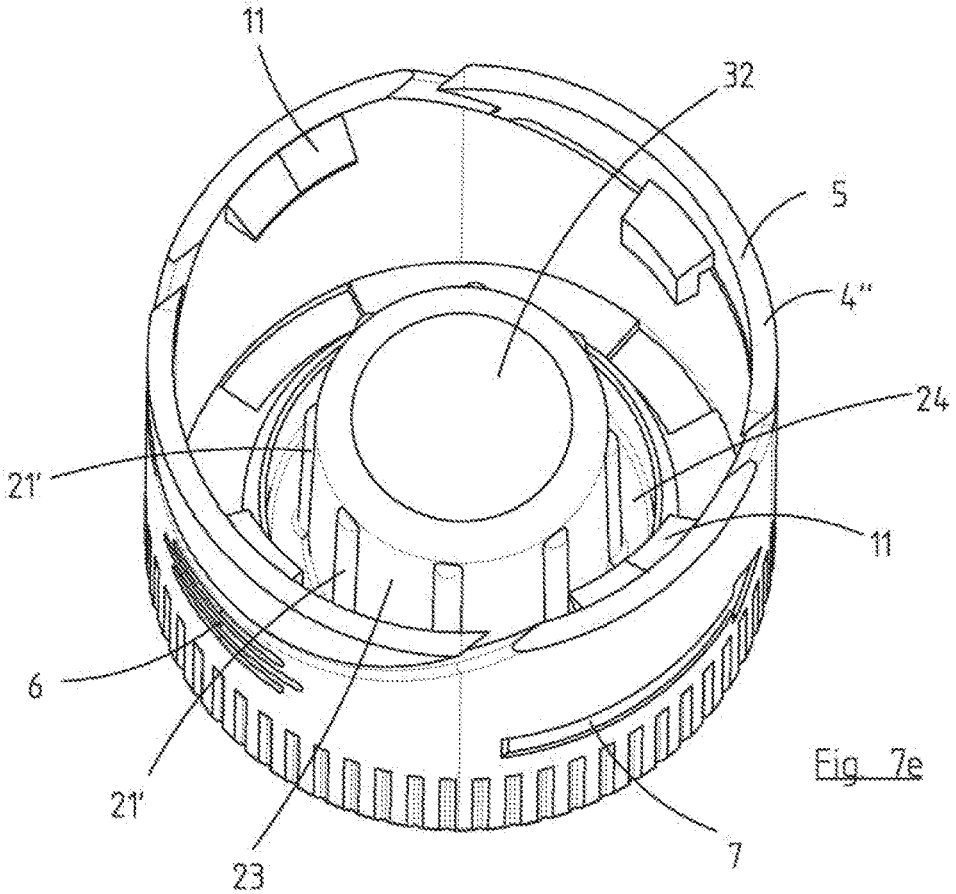
Figure 7F:
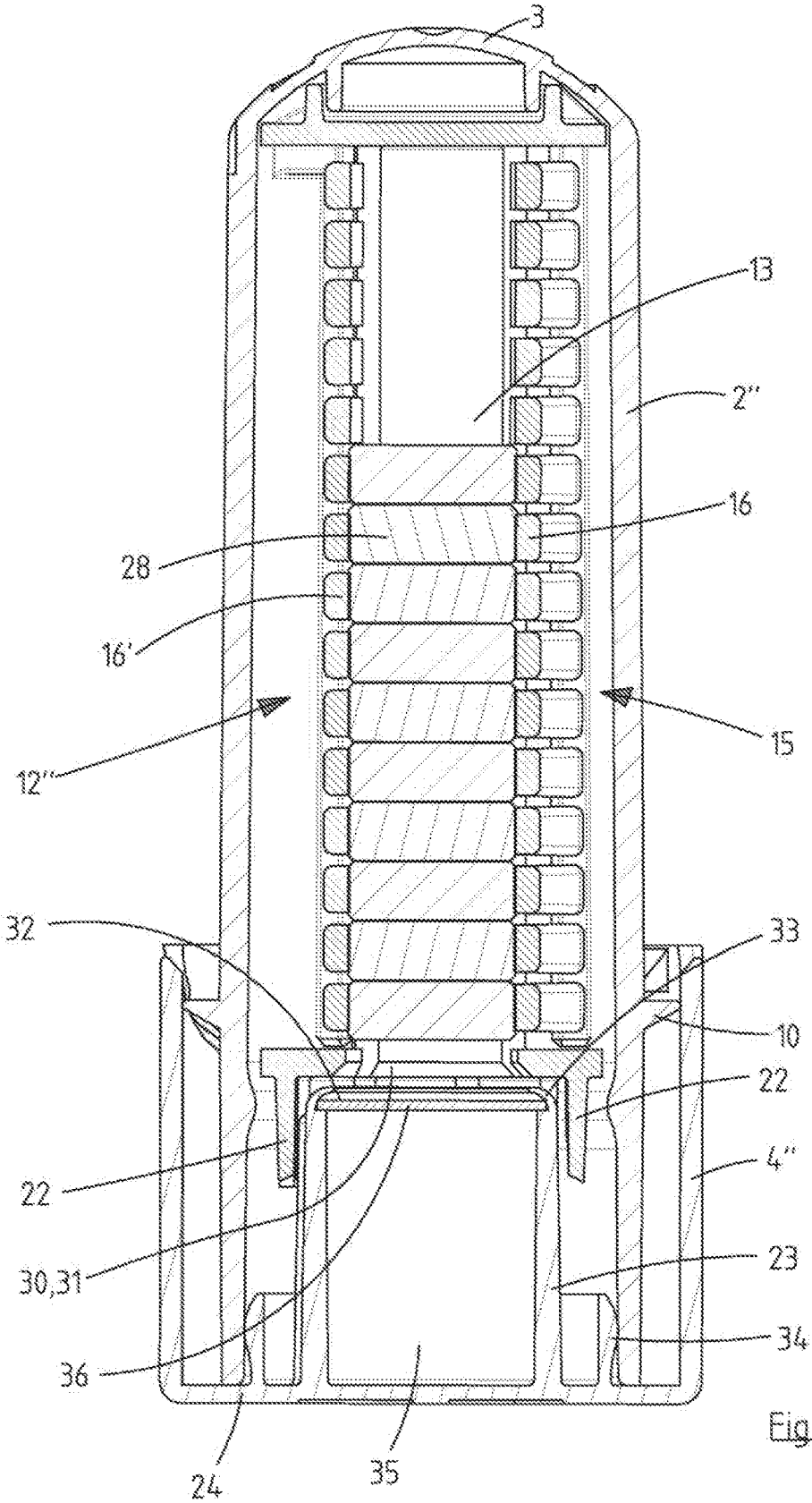
Figure 7G:
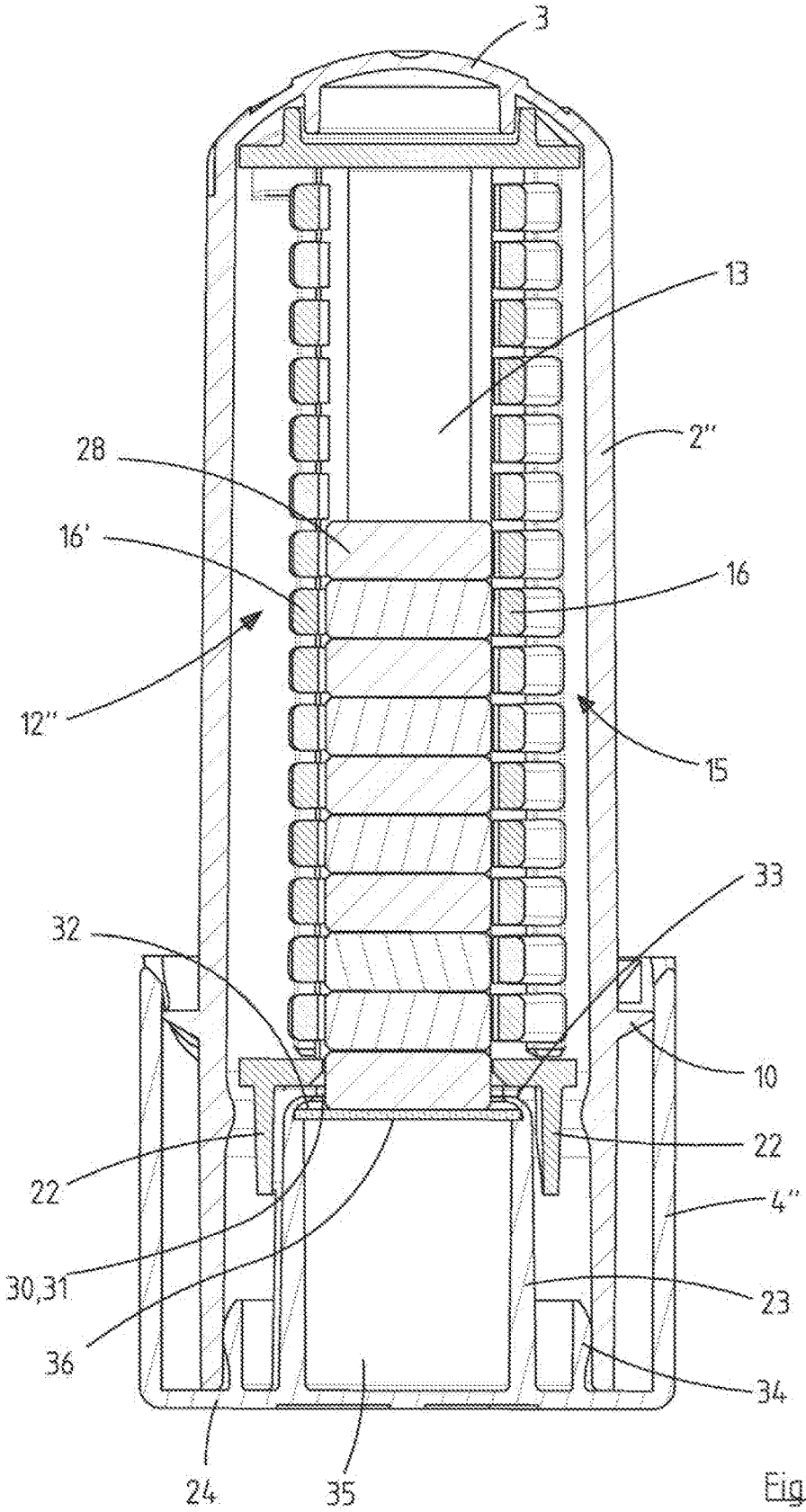
Figure 7H:
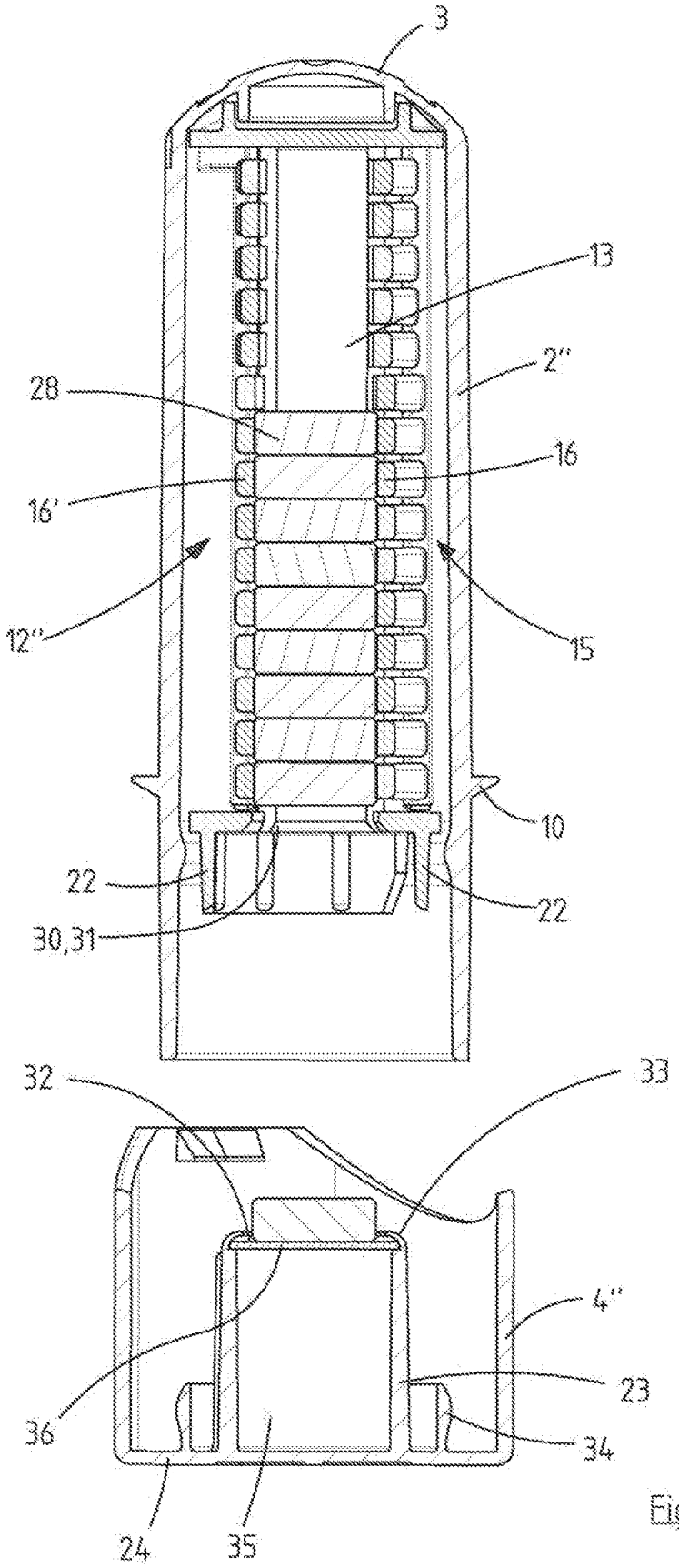
Figure 7I:
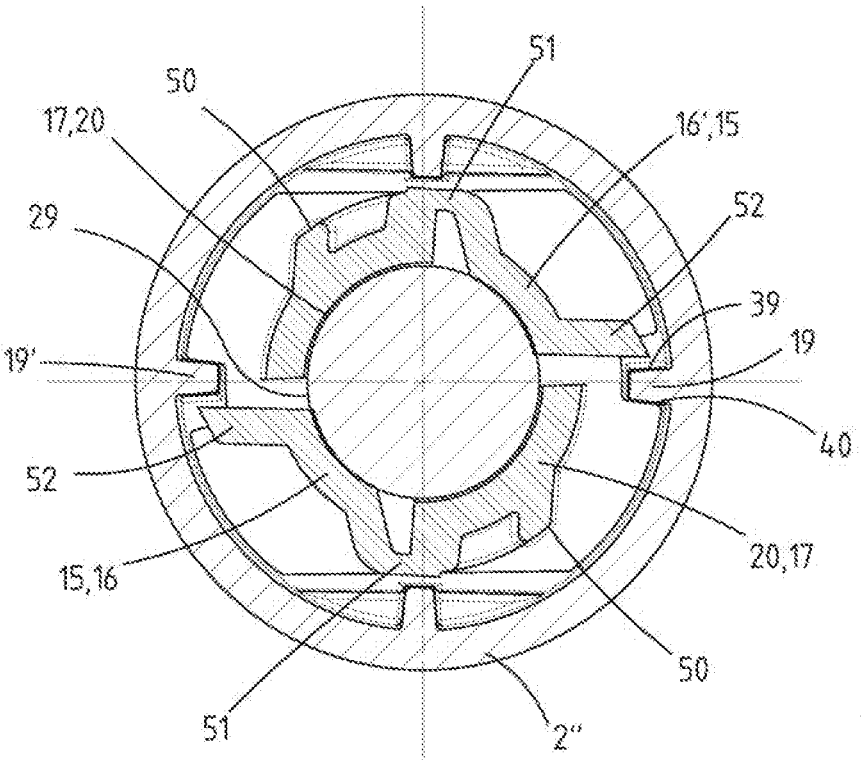
Figure 7J:
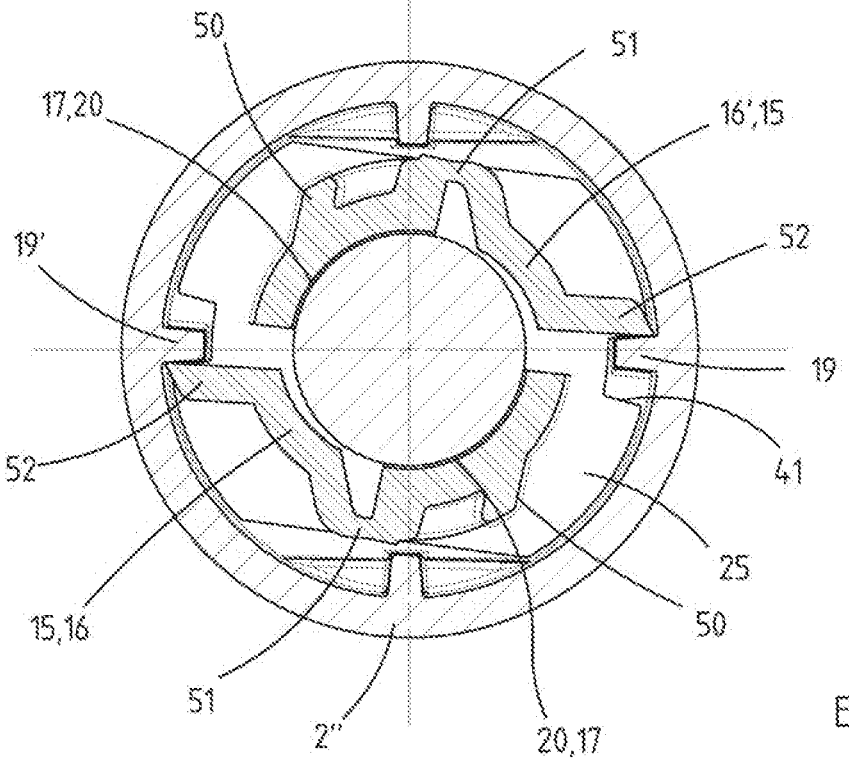

FIG. 7*a* shows a perspective view of the container 1"; FIG. 7*b* shows an exploded view of the container 1" of FIG. 7*a* with the container body 2", the holding device 12" and the cover 4". FIG. 7*c* shows a perspective view of the holding device 12" of the container 1" of FIG. 7*b*. FIG. 7*d* shows a perspective view of the container body 2" of the container of FIG. 7*a*. FIG. 7*e* shows a perspective view of the cover 4" of the container of FIG. 7*a*. FIGS. 7*f*, 7*g* and 7*h* each show a sectional view along the longitudinal axis of the container 1" of FIG. 7*a*. FIGS. 7*i* and 7*j* show cross-sections of the container 1" of FIG. 7*a*.

Figure 8A:
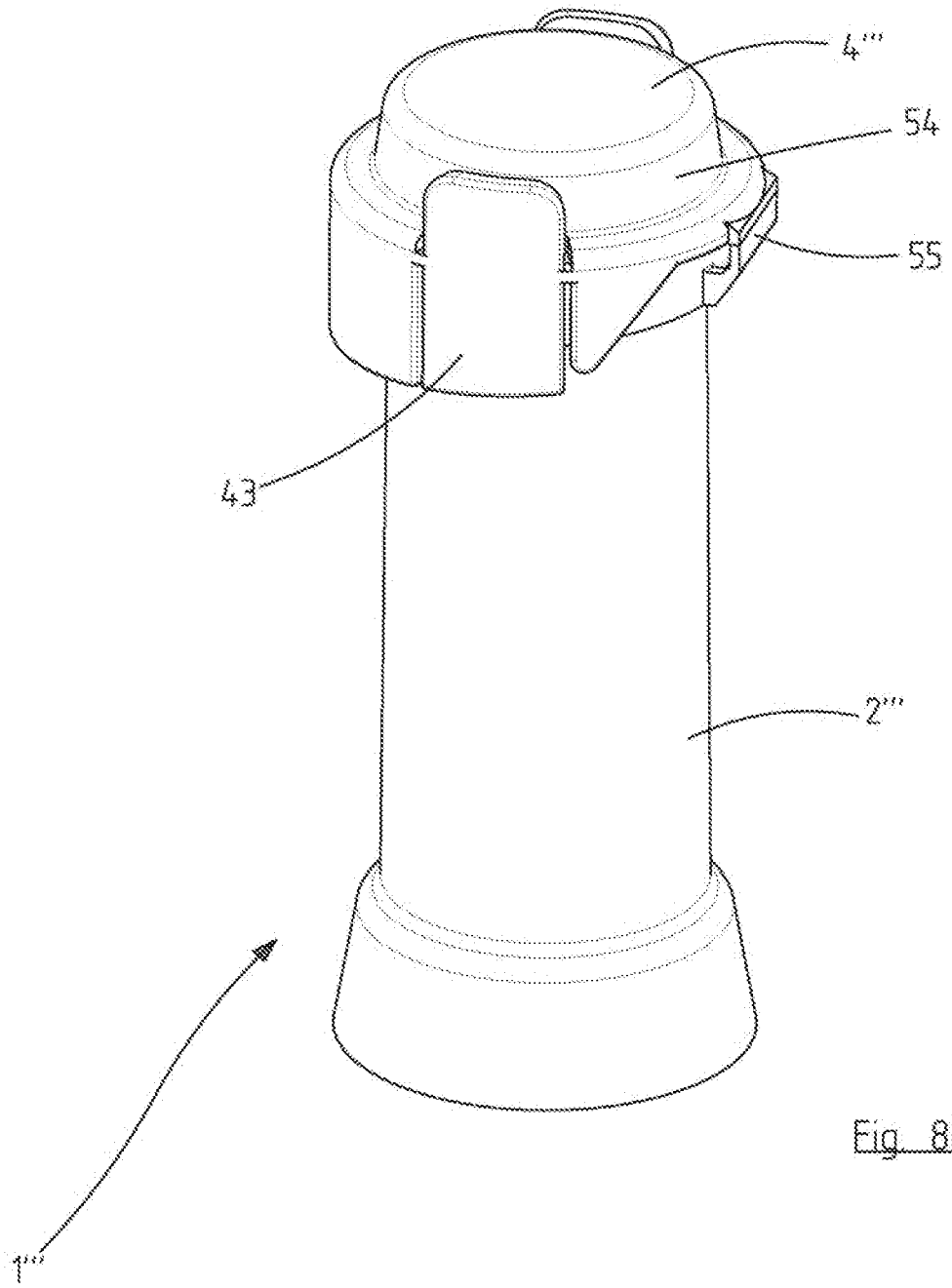
FIGS. 8*a*-8*k* show views of a still further embodiment of the container.
Figure 8B:
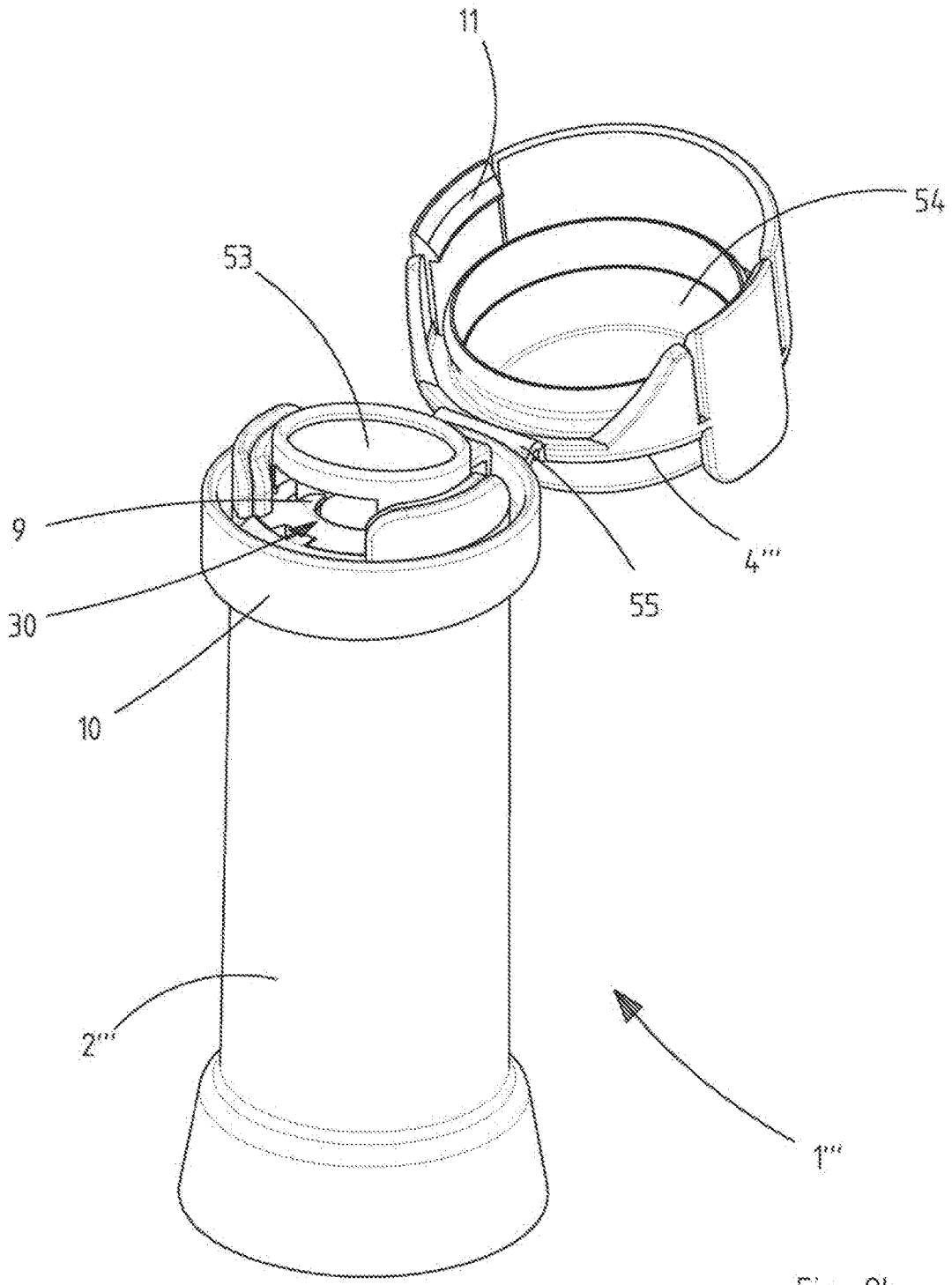
Figure 8C:
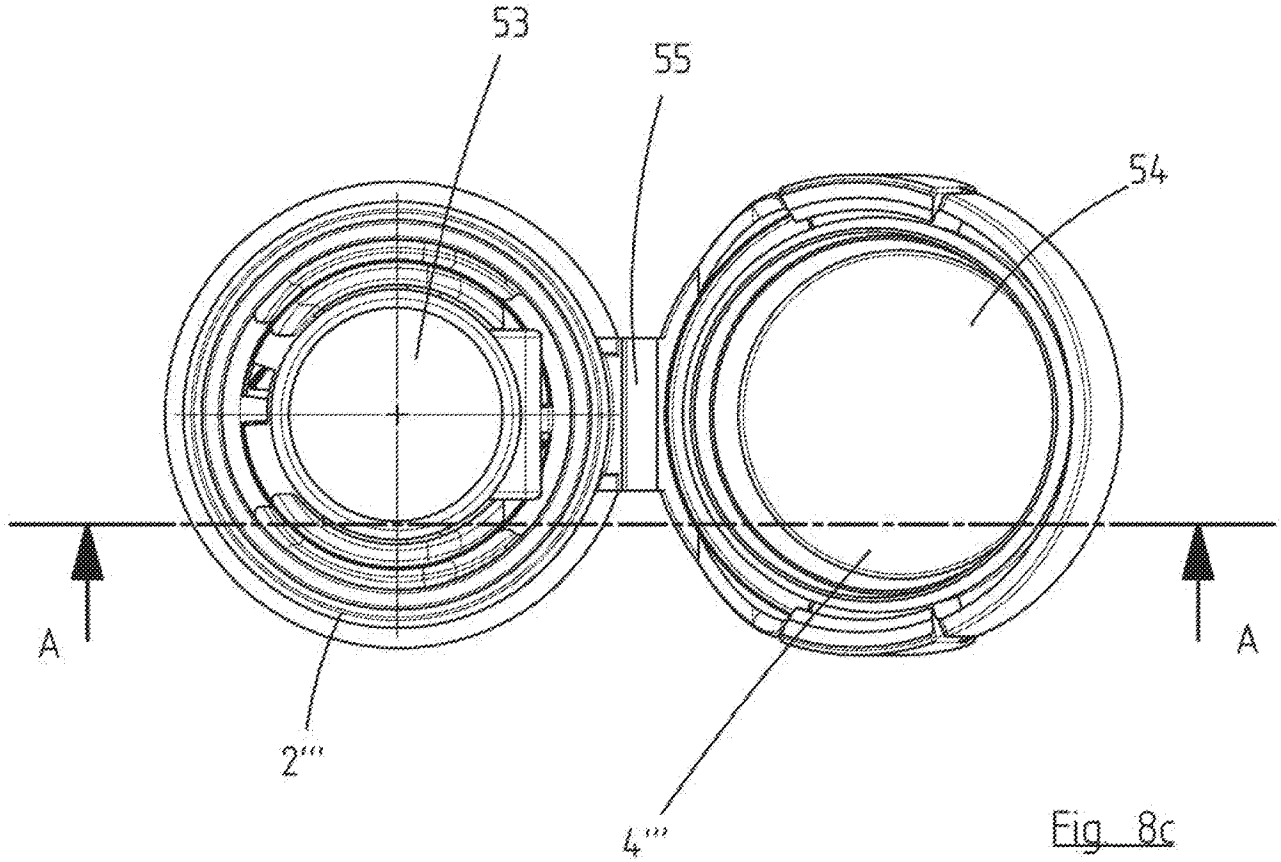
Figures 8D, 8E, 8F:
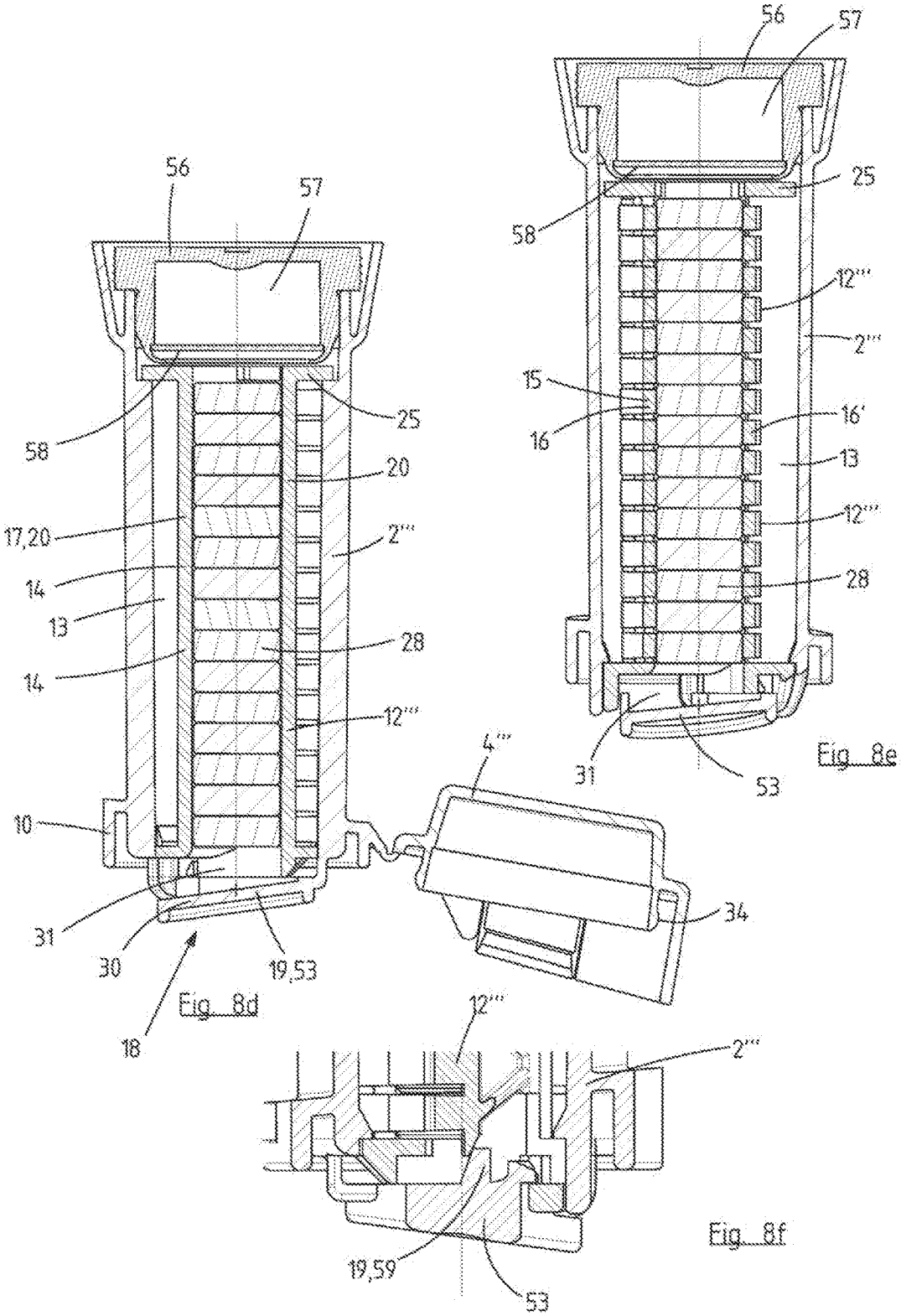
Figures 8G, 8H, 8I:
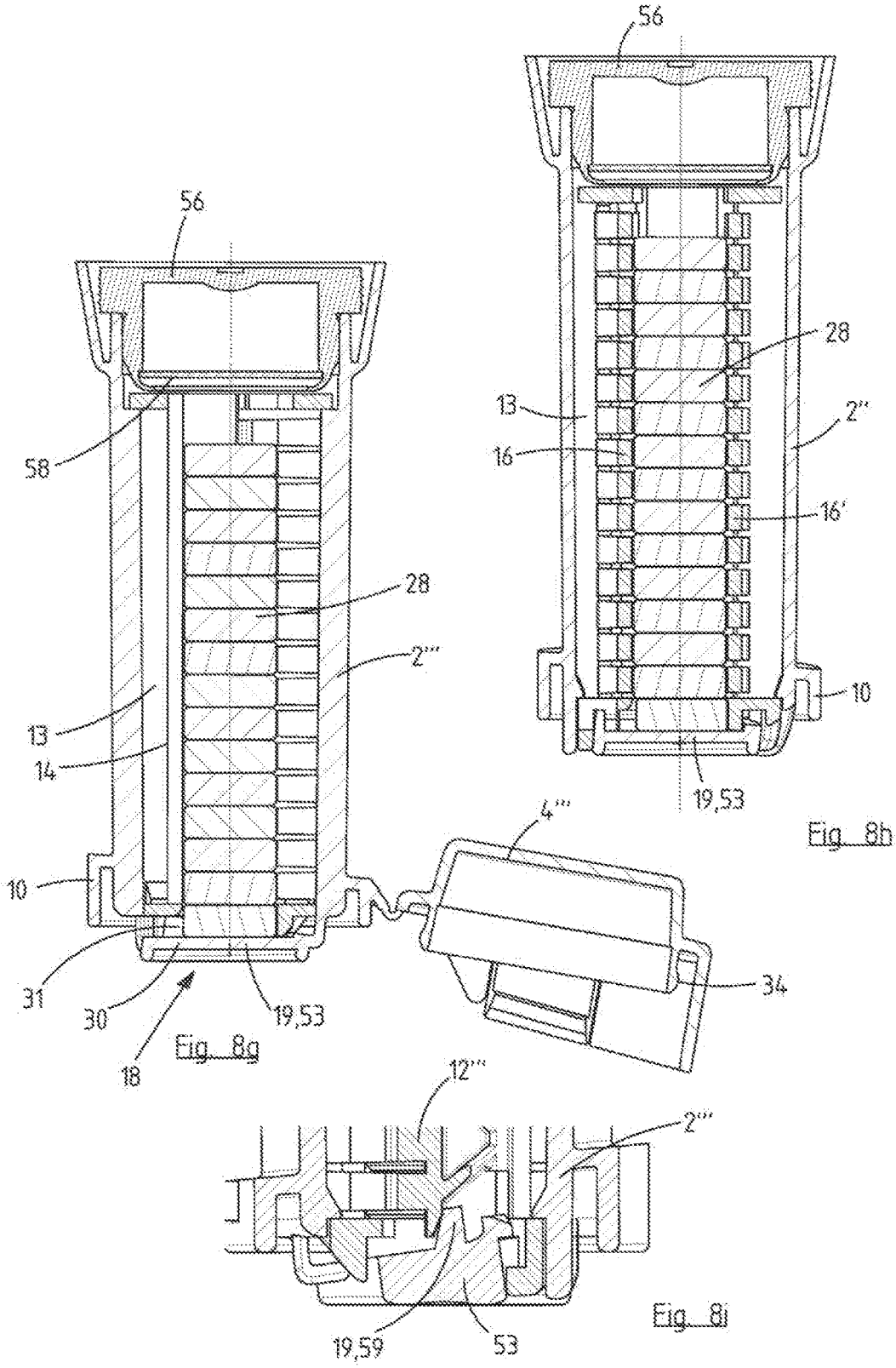
Figures 8J, 8K:
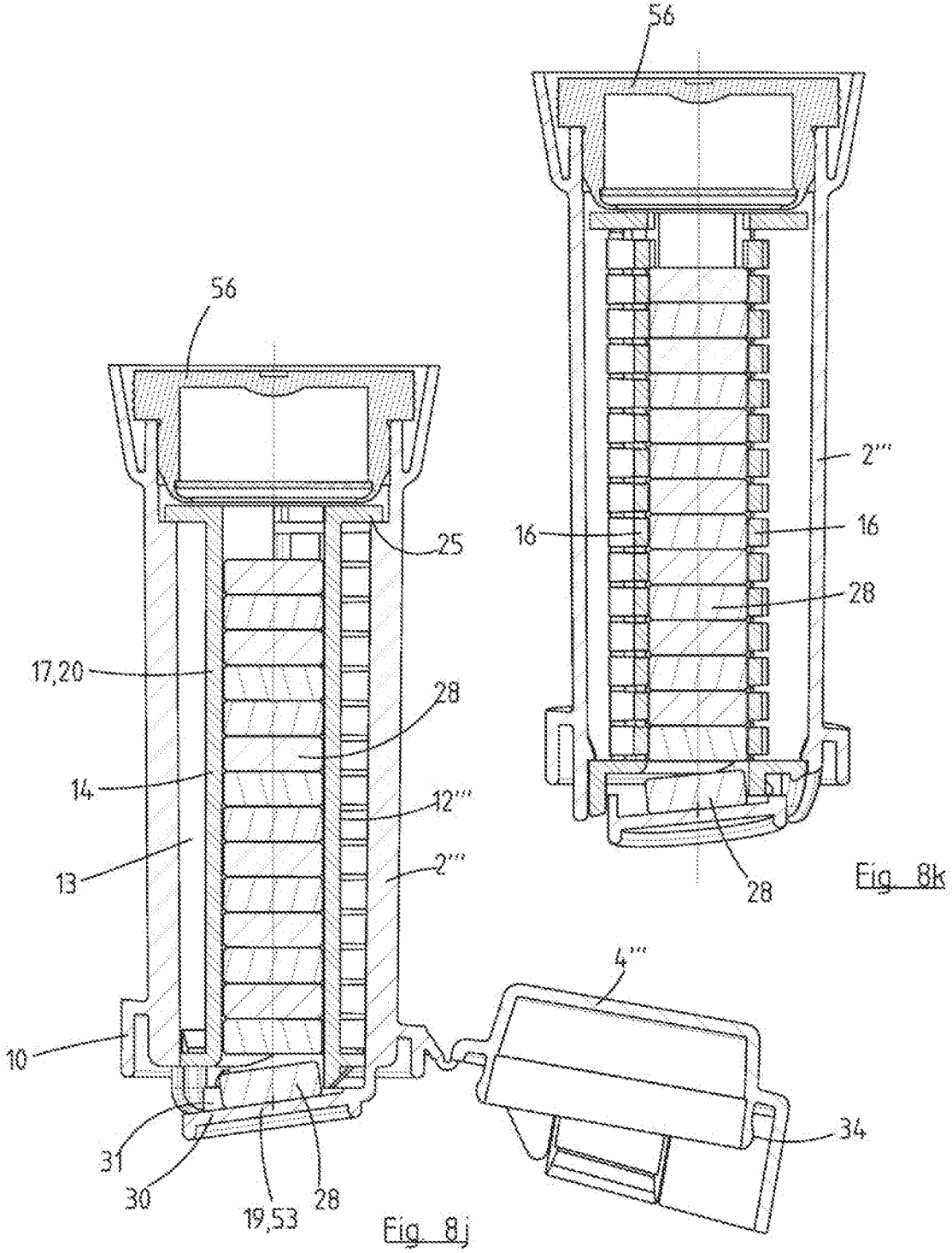

FIG. 8*a* shows a perspective view of the container 1'". FIG. 8*b* shows the container 1'" of FIG. 8*a* with an open cover 4'", whereas FIG. 8*c* shows a plan view of the container of FIG. 8*b*. FIGS. 8*d* and 8*e* show sectional illustrations along the longitudinal axis of the container of FIG. 8*a*, wherein a good to be packaged is not yet located in the dispenser. FIG. 8*f* illustrates sections of a longitudinal sectional view along the line A-A of FIG. 8*c*. FIGS. 8*g*, 8*h* and 8*i* show views corresponding to FIGS. 8*d*, 8*e* and 8*f*, wherein the holding device is open, in order to deliver a good to be packaged into the container. FIGS. 8*j* and 8*k* show views corresponding to FIGS. 8*d* and 8*e* and 8*g* and 8*h* respectively, in which a good to be packaged is available for removal in the dispenser.

FIGS. 7*a* and 7*b* clearly show the structure of the container 1". The container comprises a container body 2", a holding device 12" and a cover 4". The container body 2" has substantially a cylindrical shape. Unlike in the case of the container body of FIG. 1, the base 3 is formed with an outwardly curved shape. The base 3 thus does not form a standing surface. The cover 4", in particular the lid base 24 thereof, forms a standing surface. This facilitates intuitive operation. The user places container 1" down intuitively in the position illustrated in FIG. 7*a*, in which the container 1" faces downwards with the cover 4". This is also the position of the container 1" in which goods to be packaged 28 can be delivered—under the effect of gravitational force—into the dispenser 30.

Furthermore, the container 1" also comprises inter alia a tamper-evident lock 5, arrows 7 and positioning surfaces 8 which are formed as in the case of the container 1.

As in the case of the container 1, the goods to be packaged 28 are guided by the guide portions 20. Unlike in the case of the container 1, the guide portions are not arranged on the container body but rather on the holding device 12". In the illustrated exemplified embodiment, two opposite guide portions 20 are provided. The guide portions 20 have a shape adapted to the outer contour of the goods to be packaged 28. In order to stabilise the guide portions 20, recesses 50 are provided on the outer sides thereof. In the illustrated exemplified embodiment, the recesses 50 are formed by stiffening ribs. This can be seen particularly clearly in FIGS. 7*c* and 7*i*.

The container 1" again comprises an actuating device 18 which renders it possible to move the holding device 12 from the closed position to an open position. In the case of the illustrated exemplified embodiment, the actuating device 18 is arranged in the interior of the container body 2". It comprises actuating elements 19 and 19'. In the embodiment illustrated in FIGS. 7*a* to 7*j*, the actuating elements are arranged on the inner side of the container body 2". They are formed by radially inwardly protruding portions of the container body 2". The actuating elements 19, 19' are formed as ribs which are arranged on the inner wall of the container body 2". This can be seen particularly clearly in FIGS. 7*d* and 7*i*.

The holding device 12" again comprises clamping device 15, in order to fix the goods to be packaged 28. The clamping device 15 comprise holding tongues 16, 16'. In the closed position illustrated in FIG. 7*e*, the clamping device 15 press against the goods to be packaged 28. If the holding device 12 is moved to the open position (cf. 7*g* and 7*j*), the clamping device 15 release the goods to be packaged 28. The goods to be packaged 28 can then move in the direction of the longitudinal axis of the container body 2", in order to deliver a good to be packaged 28 into the dispenser 30. The clamping device 15 again comprise a multiplicity of holding tongues 16, 16'. The holding tongues 16, 16' are connected to the holder 17 in each case by means of a movable portion 51. The movable portion 51 is formed as a bending region. By rotating the container body 2" relative to the holding device 12", the holding device 12" can be opened. FIG. 7*j* clearly shows that during rotation the actuating element 19 or 19' moves the holding device 12 to the open position. In this case, the actuating element 19 or 19' presses the clamping device 15 (or their holding tongues 16, 16') from their rest position illustrated in FIG. 7*i* to the actuating position illustrated in FIG. 7*j*. In this case, the inner width between the clamping device 15 can be enlarged and the goods to be packaged 28 are released. The holding tabs 16, 16' comprise outwardly facing actuating portions 52 which cooperate with the actuating elements 19, 19'.

FIGS. 7*f* to 7*h* illustrate once again the mode of operation of the container 1". FIG. 7*f* shows a container 1" filled with a stack of goods to be packaged 28. The individual goods to be packaged 28 are held in each case by the holding tongues 16, 16' of the clamping device 15. The dispenser 30 comprises a chamber 31 which is initially still empty. FIG. 7*g* shows the container 1" with an open holding device 12". The holding tongues 16, 16' are pressed outwards and release the goods to be packaged 28. They can now move a short distance downwards, wherein the lowermost good to be packaged 28 comes to lie in the chamber 31. The holding device 12" is opened by rotating the cover 4" in the direction of the arrows 7. If the cover 4" is now released, the holding tongues 16, 16' return to the closed position by reason of their elastic pretensioning (cf. FIGS. 7*h* and 7*i*). It can also be seen in FIG. 7*h* that the cover 4" can now be removed. The good to be packaged 28 to be removed lies on the cover 36 and can be removed without problem.

Even in the case of the embodiment illustrated in FIGS. 7*a* to 7*j*, the movement between the holding device 12" and the container body 2" is limited, in order to avoid any undesired deformation of the clamping device 15. For this purpose, the container body 2" again comprises a stop 40. This is formed by the rib-shaped actuating element 19. The holding device 12" is provided with a U-shaped cut-out which encompasses the actuating element 19, 19' and thus limits the rotational capability of the holding device 12" with respect to the container body 2".

The container illustrated in FIGS. 8*a* to 8*k* again comprises a container body 2'", a holding device 12'" and a cover 4'" which are configured in a similar manner as in the case of the previously described containers 1 and 1". However, a different operating concept is realised in the case of the container 1'". Whereas in the case of the container 1 and 1" the opening of the holding device 12 has been effected by means of a rotation of the cover 4, in the case of the embodiment illustrated in FIGS. 8*a* to 8*k* this is effected by moving an actuating piece 53. In the illustrated exemplified embodiment, the actuating piece 53 is formed as an actuating button. By pressing the actuating piece 53, the holding device 12'" can be rotated relative to the container body 2'". The holding device 12'" is opened by means of the rotation precisely as in the case of the previously described embodiments.

FIG. 8*a* shows the container 1'" with the cover 4'" in its closed position. The cover 4'" comprises a lid portion 54 which is connected to the container body 2'" by means of a hinge 55. The cover 4'" and the container body 2'" are formed in one piece; the hinge 55 is formed by a film hinge.

FIG. 8*b* shows the cover 4'" in the open position, in which the actuating piece 53 and the dispenser 30 are accessible.

At the end opposite the cover 4'", the container body 2'" comprises a closure 56. In the illustrated exemplified embodiment, this is formed as a closure plug. The closure 56 can comprise, as illustrated (cf. e.g. FIG. 8*d*), a drying agent chamber 57 which is connected to the receiving space 13 by means of a moisture-permeable cover 58.

The holding device 12' is formed substantially like the holding device 12". This applies in particular to the embodiment of the clamping device 15 having the holding tongues 16, 16' and also the embodiment of the guide portions 20. In order to open the holding device 12', the holding device is again rotated relative to the container body 2". The actuation is effected via the actuating piece 53. FIGS. 8*d* and 8*e* show two longitudinal sectional views of the container 1' which are offset by 90 degrees. In this case, the container 1' is illustrated completely filled with the goods to be packaged 28. The chamber 31 of the dispenser 30 is initially still empty. The actuating piece 53 is located in its rest position. The actuating piece 53 can be moved towards the container body 2' by pressing. This position is illustrated in FIGS. 8*g* to 8*i*. In this case, the clamping device 15 are opened so that the goods to be packaged 28 can move downwards, wherein the lowermost one of the goods to be packaged 28 comes to lie in the chamber 31 of the dispenser 30. By releasing the actuating piece 53, the actuating piece returns in a resilient manner to the position illustrated in FIGS. 8*j* and 8*k*. A good to be packaged 28 lies available on the inner side of the actuating piece 53 and can be removed. In order to facilitate this, the chamber 31 is arranged in the rest position in an oblique manner with respect to the longitudinal axis of the container body 2' so that the good to be packaged 28 can slide along on this oblique surface.

In the position illustrated in FIG. 8*g*, the insert 14 is rotated relative to the container body 2'" to such an extent that the illustrated sectional course extends through the gap between the holding fins 16 or 16' and the guide portion 17 (cf. also the comparable cross-sectional views in FIGS. 7*i* and 7*j*).

The actuating piece 53 is arranged in a resilient manner and independently returns to the rest position if no pressure is exerted upon the actuating piece 53.

FIGS. 8*f* and 8*i* illustrate how the movement of the actuating piece 53 results in a rotation of the holding device 12'". 8*f* shows the actuating piece 53 in its rest position. If the actuating piece 53 is pressed, as illustrated in FIG. 8*i*, the holding device 12'" is rotated by correspondingly formed actuating members until the clamping device 15 are opened.

Naturally, it is also possible to combine features of the different embodiments in an expedient manner. The description of the exemplified embodiments is thus to be understood such that expedient combinations of individual features or a plurality of features of the different embodiments also form the subject matter of the invention.

The invention claimed is:

1. A container for a plurality of goods to be packaged, comprising:

a container body which forms a receiving space for the plurality of goods to be packaged, a dispenser for dispensing the plurality of goods to be packaged; and a holding device for holding the plurality of goods to be packaged in the receiving space, wherein the holding device can assume an open position, in which at least one of the goods to be packaged can be moved from the receiving space into the dispenser, and a closed position, in which the goods to be packaged are held in the receiving space, wherein the holding device comprises a clamping device configured to hold the goods to be packaged in a clamping manner, wherein an actuating device is provided, in order to move the holding device to the open position, wherein the actuating device comprises an actuating element, wherein the actuating element and the holding device can assume a rest position and an actuating position with respect to one another, wherein the actuating element in the actuating position opens the holding device, in that it enlarges the inner width of the holding device.

2. The container as claimed in claim 1, wherein the holding device is configured to hold a stack of goods to be packaged.

3. The container as claimed in claim 1, wherein the holding device holds the goods to be packaged at a spaced interval with respect to the container body.

4. The container as claimed in claim 1, wherein the clamping device in the closed position applies a clamping force in a radial direction inwards to a peripheral surface of the goods to be packaged.

5. The container as claimed in claim 1, wherein the clamping device comprises a holding strip and/or a holding tongue, which are fastened in an elastically movable manner to a holder, in order to lie against the goods to be packaged and to hold same thereby.

6. The container as claimed in claim 5, wherein a multiplicity of holding tongues are arranged on the holder in a row next to one another.

7. The container as claimed in claim 1, wherein the actuating element is arranged on the container body.

8. The container as claimed in claim 1, wherein the actuating element is arranged on the holding device.

9. The container as claimed in claim 1, wherein the holding device comprises an insert which is movably inserted in the container body, wherein the insert is movable with respect to the actuating element such that the actuating element comprises a pressure surface that cooperates with the holding device in the actuating position to open the holding device.

10. The container as claimed in claim 1, wherein the dispenser comprises a chamber in which at least one good to be packaged can be received without being held by the holding device in the closed position thereof.

11. The container as claimed in claim 1, further comprising:

a cover, configured to close a container opening of the container body and/or cover the chamber of the dispenser, and a catch coupled to the cover and the holding device and transferring a movement of the cover, in particular a rotation of the cover, relative to the container body to the holding device.

12. The container as claimed in claim 11, wherein the container body comprises a stop, which cooperates with a mating stop surface of the holding device, in order to limit a movement of the holding device relative to the container body, and in that the catch is formed as a latching means which permits a continuation of the movement of the cover relative to the container body if the stop cooperates with the mating stop surface.

13. The container as claimed in claim 1, wherein the container body and the actuating device form a first synthetic material injection-moulded part, the holding device comprising an insert that forms a second synthetic material injection-moulded part, and/or the cover forms a third synthetic material injection-moulded part.

14. The container as claimed in claim 13, wherein the holding device comprises an insert which is movably inserted in the container body, wherein the insert is movable with respect to the actuating element such that the actuating element has a pressure surface that cooperates with the holding device in the actuating position to open the holding device, wherein the insert comprises a second synthetic material injection-moulded part.

15. The container as claimed in claim 14, further comprising:

a cover configured to close a container opening of the container body and/or cover the chamber of the dispenser, and a catch coupled to the cover and the holding device and transferring a movement of the cover, in particular a rotation of the cover, relative to the container body to the holding device, wherein the cover comprises a third synthetic material injection-moulded part.

16. The container as claimed in claim 2, wherein the holding device holds the goods to be packaged at a spaced interval with respect to the container body.

17. The container as claimed in claim 2, wherein the clamping device in the closed position applies a clamping force in a radial direction inwards to a peripheral surface of the goods to be packaged.

18. The container as claimed in claim 2, wherein the clamping device comprises a holding strip and/or a holding tongue, which are fastened in an elastically movable manner to a holder, in order to lie against the goods to be packaged and to hold same thereby.

19. The container as claimed in claim 18, wherein a multiplicity of holding tongues are arranged on the holder in a row next to one another.

20. A container for a plurality of goods to be packaged, comprising:

a container body which forms a receiving space for the plurality of goods to be packaged, a dispenser for dispensing the plurality of goods to be packaged; and a holding device for holding the plurality of goods to be packaged in the receiving space, wherein the holding device can assume an open position, in which at least one of the goods to be packaged can be moved from the receiving space into the dispenser, and a closed position, in which the goods to be packaged are held in the receiving space, wherein the holding device comprises a clamping device configured to hold the goods to be packaged in a clamping manner, wherein an actuating device is provided, in order to move the holding device to the open position, wherein the actuating device comprises an actuating element, wherein the actuating element and the holding device can assume a rest position and an actuating position with respect to one another, wherein the actuating element in the actuating position opens the holding device in that it enlarges the inner width of the holding device, wherein the holding device is configured to hold a stack of goods to be packaged, wherein the holding device holds the goods to be packaged at a spaced interval with respect to the container body, wherein the clamping device in the closed position applies a clamping force in a radial direction inwards to a peripheral surface of the goods to be packaged.

* * * * *